US010348060B2

(12) United States Patent
Watanabe et al.

(10) Patent No.: US 10,348,060 B2
(45) Date of Patent: Jul. 9, 2019

(54) SPARK PLUG

(71) Applicant: DENSO CORPORATION, Kariya, Aichi-pref. (JP)

(72) Inventors: Tomoyuki Watanabe, Kariya (JP); Ryohei Akiyoshi, Kariya (JP); Ryuichi Ohno, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/687,854

(22) Filed: Aug. 28, 2017

(65) Prior Publication Data

US 2018/0062355 A1 Mar. 1, 2018

(30) Foreign Application Priority Data

Aug. 30, 2016 (JP) ..... 2016-167860

(51) Int. Cl.
*H01T 13/32* (2006.01)

(52) U.S. Cl.
CPC ..... *H01T 13/32* (2013.01)

(58) Field of Classification Search
CPC ..... H01T 13/32
See application file for complete search history.

(56) References Cited

U.S. PATENT DOCUMENTS 6,166,480 A 12/2000 Ishida et al.
2001/0029916 A1 10/2001 Kanao
2002/0038992 A1 4/2002 Morita et al.
2002/0067111 A1* 6/2002 Shibata ..... H01T 13/32 313/141
2002/0108606 A1 8/2002 Miwa et al.
2003/0193282 A1 10/2003 Shibata et al.
2004/0061421 A1 4/2004 Morita et al.
2005/0016485 A1 1/2005 Miwa et al.
2005/0264151 A1 12/2005 Mori et al.
2007/0080618 A1 4/2007 Torii et al.
2013/0099652 A1 4/2013 Below et al.
2013/0328476 A1 12/2013 Ban et al.
2014/0021853 A1* 1/2014 Shimizu ..... H01T 13/20 313/141
2014/0333195 A1* 11/2014 Nishikawa ..... H01T 13/32 313/141

FOREIGN PATENT DOCUMENTS

JP 2012-256590 12/2012

* cited by examiner

*Primary Examiner* — Nimeshkumar D Patel
*Assistant Examiner* — Jacob R Stern
(74) *Attorney, Agent, or Firm* — Nixon & Vanderhye P.C.

(57) ABSTRACT

When one of a center chip and a ground chip of a spark plug is defined as a first chip and another one is defined as a second chip, a discharge starting ridge line, which is a straight ridge line that forms a boundary between two surfaces having different normal line directions, is formed in a portion closest to the second chip in the first chips, and a distance from the discharge starting ridge line to the second chip is configured to be equal at a portion where the first chip and the second chip are opposed to each other.

20 Claims, 16 Drawing Sheets

COMPARATIVE EXAMPLE

SPARK PLUG

CROSS-REFERENCE TO RELATED APPLICATION

This application is based on and claims the benefit of priority from earlier Japanese Patent Application No. 2016-167860 filed Aug. 30, 2016, the description of which is incorporated herein by reference.

TECHNICAL FIELD

The present disclosure relates to a spark plug for an internal combustion engine.

BACKGROUND

An internal combustion engine is provided with a spark plug for igniting an air-fuel mixture in a combustion chamber.

The spark plug is for igniting the air-fuel mixture by generating a spark discharge between two electrodes which are separated from each other.

Various proposals have been made concerning shapes and arrangements of electrodes of the spark plug.

For example, a spark plug disclosed in Patent Document 1 (Japanese Patent Application Laid-Open Publication No. 2002-324650) includes a center electrode provided with a columnar center electrode side chip and a ground electrode provided and with a columnar ground electrode side chip.

A spark discharge is generated between a distal end surface of the center electrode side chip and a distal end surface of the ground electrode side chip in the spark plug.

Further, the spark plug has a configuration in which a center axis of the ground electrode side chip is inclined with respect to a center axis of the center electrode side chip (and a center axis of the center electrode).

As a result, the distal end surface of the center electrode side chip and the distal end surface of the ground electrode side chip are not parallel to each other, and both are disposed obliquely opposite to each other.

In such a configuration, a wider space between the ground electrode and the center electrode is secured as compared with a configuration in which the ground electrode extends to a position right above the center electrode (that is, a position overlapping with the center axis of the center electrode).

Therefore, it is possible to prevent such a phenomenon that a flame kernel generated in vicinity of the center electrode comes into contact with a surface of the ground electrode and inhibiting a growth of the flame kernel from occurring, thereby sufficient ignition performance can be performed.

In addition, as a result of the ground electrode being shortened, it is also possible to obtain an effect of improving the heat extractability of the ground electrode in the above configuration.

In order to perform the ignition performance of the spark plug stably over a long period of time, a distance between the electrodes, that is, a discharge distance which is a distance between the center electrode side chip and the ground electrode side chip is desirable to be kept constant for a long period of time.

However, since the surface of each chip wears little by little with an impact of spark discharge, the discharge distance gradually increases.

In the configuration disclosed in the above-mentioned Patent Document 1, a portion closest to the ground electrode side chip in the center electrode side chip is a single point at a position nearest to the ground electrode in a circular edge of the distal end surface.

Therefore, this point becomes a starting point of the spark discharge in an initial stage.

In such a configuration, since the starting point of the spark discharge concentrates at the above-mentioned point, the distal end surface of the center electrode side chip rapidly wears out at the above point.

As a result, the discharge distance between the center electrode side chip and the ground electrode side chip spreads at a relatively high speed, and the ignition performance of the spark plug decreases in a short period of time to cause misfire.

SUMMARY

An embodiment provides a spark plug capable of preventing deterioration of an ignition performance due to an increase in a discharge distance over a long period of time.

In a spark plug according to a first aspect, the spark plug for an internal combustion engine includes a columnar metal fitting, a center electrode disposed along a center axis of the metal fitting and supported in a state of being electrically insulated from the metal fitting, a center chip disposed so as to protrude from a part of the center electrode, a ground electrode of which one end is fixed to the metal fitting and at least a part of the ground electrode is inclined with respect to the center axis so as to approach the center axis of the metal fitting toward another end of the ground electrode, and a ground chip disposed so as to protrude from a part of the ground electrode toward the center chip.

A center axis of the ground chip is inclined with respect to the center axis of the metal fitting.

When one of the center chip and the ground chip is defined as a first chip and another one is defined as a second chip, a discharge starting ridge line, which is a straight ridge line that forms a boundary between two surfaces having different normal line directions, is formed in a portion closest to the second chip in the first chip, and a distance from the discharge starting ridge line to the second chip is configured to be equal at a portion where the first chip and the second chip are opposed to each other.

In the spark plug having such a configuration, a portion closest to the second chip in the first chips is not a specific point but a straight discharge starting ridge line.

The spark discharge during the operation of the spark plug is started between a single point on the discharge starting ridge line formed on the first chip and a surface (for example, the distal end surface) of the second chip.

When the point on the discharge starting ridge line of the first chip (a point which is a starting point of the spark discharge) is worn out due to the impact of the spark discharge, the distance to the second chip becomes large in that portion (the worn out point).

However, the distance to the surface of the second chip is maintained at an initial distance at other portions on the discharge starting ridge line.

The spark discharge of the next time and thereafter will be generated starting from a point on the discharge starting ridge line different from the above point.

That is, in the spark plug having the above configuration, even if a part of the first chip is worn out due to the spark discharge, the discharge distance which is the shortest distance from the discharge starting ridge line to the second chip does not change while maintaining its initial distance.

The reason for the discharge distance changing from the original distance is that all the points on the discharge starting ridge have been worn out.

As described above, it is possible to prevent the discharge distance from being increased, and the ignition performance from being lowered accordingly, over a long period of time in the spark plug having the above-described configuration.

According to the present disclosure, a spark plug capable of preventing deterioration of an ignition performance due to an increase in a discharge distance over a long period of time can be provided.

DETAILED DESCRIPTION OF THE PREFERRED EMBODIMENT

Figure 1:
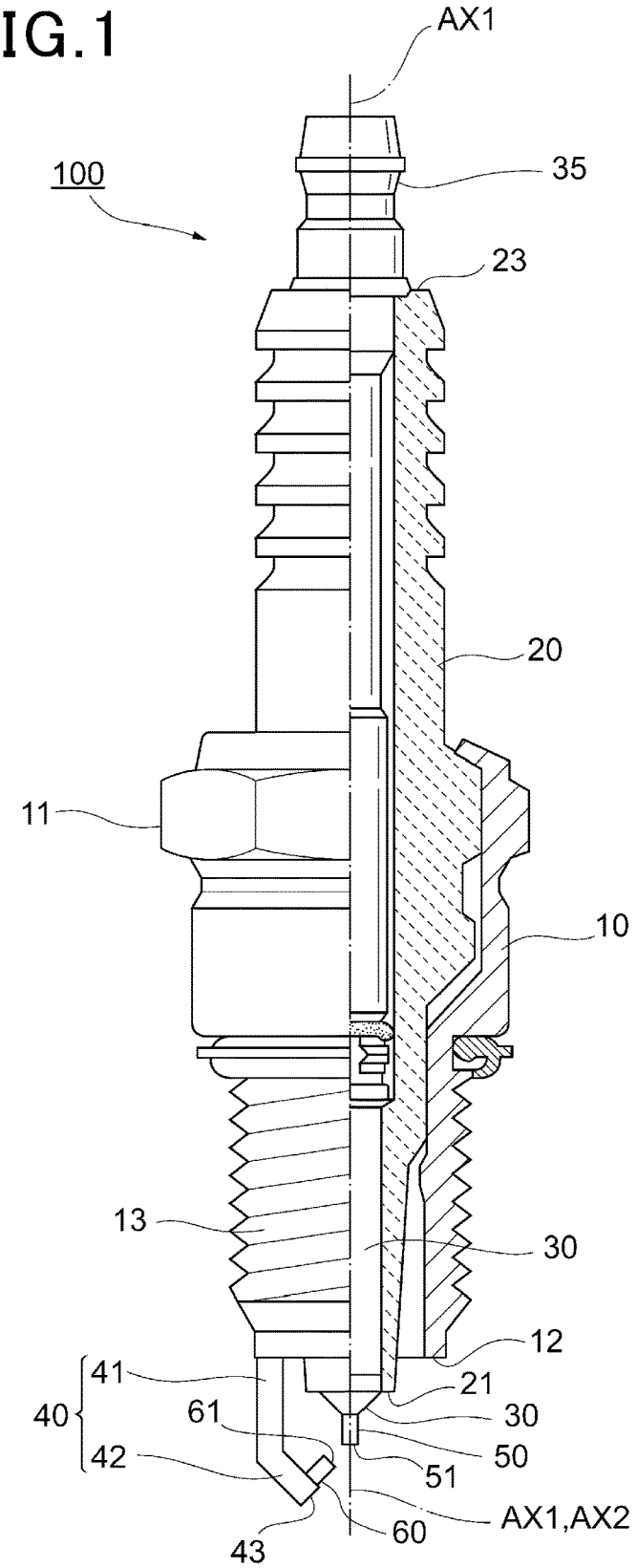
FIG. 1 shows a partial sectional view of an entire configuration of a spark plug according to a first embodiment of the present disclosure.

Hereinafter, embodiments of the present disclosure will be described with reference to the accompanying drawings.

In order to facilitate the understanding of the explanation, the same reference numerals are used for the same constituent elements in each drawing as much as possible and redundant explanations are omitted.

A configuration of a spark plug 100 according to a first embodiment will be described with reference to FIG. 1.

The spark plug 100 is a device for generating a spark discharge in a combustion chamber of an internal combustion engine (not shown), thereby igniting an air-fuel mixture in the combustion chamber.

The spark plug 100 includes a metal fitting 10, an insulator 20, a center electrode 30, and a ground electrode 40.

The metal fitting 10 is a portion to be attached to the internal combustion engine.

The entire metal fitting 10 is formed in a columnar shape, and holds the insulator 20 and the center electrode 30 which will be described later inside the metal fitting 10.

A male thread portion 13 and a hexagonal nut portion 11 are formed on an outer surface of the metal fitting 10.

The male thread portion 13 is a portion that is inserted and fixed in a screw hole (a hole formed by female screw processing on an inner wall surface) formed on a wall of the internal combustion engine.

When attaching the spark plug 100 to the internal combustion engine, an operator rotates the hexagonal nut portion 11 using a tool such as a torque wrench to tighten and fix the spark plug 100 with respect to the screw hole.

When the spark plug 100 is attached to the internal combustion engine, the center electrode 30 and the ground electrode 40 are placed in the combustion chamber of the internal combustion engine.

The insulator 20 is a member for ensuring electrical insulation between the metal fitting 10 and the center electrode 30.

The insulator 20 is made of alumina ceramics in the present embodiment.

The entire insulator 20 is formed in a columnar shape, and holds the center electrode 30 therein.

The insulator 20 is fixed to an inner surface of the metal fitting 10 in a state in which its center axis is aligned with a center axis AX1 of the metal fitting 10.

An end portion 21 of the insulator 20 on the combustion chamber side further protrudes outward (downward in FIG. 1) from an end portion 12 of the metal fitting 10.

Further, an end portion 23 of the insulator 20 on a side opposite to the combustion chamber also protrudes outward (upward in FIG. 1) from the metal fitting 10.

A part of a terminal 35 for applying a voltage to the center electrode 30 is accommodated inside the insulator 20.

A remaining part of the terminal 35 further protrudes outward (upward in FIG. 1) from the end portion 23 of the insulator 20.

The terminal 35 and the center electrode 30 are electrically connected through a resistor.

The center electrode 30 is a substantially columnar member formed of a nickel-based alloy containing nickel as a main component.

The center electrode 30 is fixed to an inner surface of the insulator 20 in a state in which its center axis is aligned with the center axis AX1 of the metal fitting 10.

That is, the center electrode 30 is disposed along the center axis AX1 of the metal fitting 10.

An end portion of the center electrode 30 on the combustion chamber side further protrudes outward (downward in FIG. 1) from the end portion 21 of the insulator 20.

As shown in FIG. 1, a shape of the end portion of the center electrode 30 protruding from the end portion 21 of the insulator 20 is tapered such that its diameter decreases toward a distal end side thereof.

The center electrode 30 is supported in a state of being electrically insulated from the metal fitting 10.

A center chip 50 is provided at a distal end of the end portion of the center electrode 30 protruding from the end portion 21 of the insulator 20, that is, at the distal end of the end portion of the center electrode 30 on the combustion chamber side.

The center chip 50 is formed of a noble metal such as platinum.

The center chip 50 is welded and fixed to the distal end of the center electrode 30 in a state in which its center axis AX2 is aligned with the center axis AX1 of the metal fitting 10.

As a result, the center chip 50 is in a state of protruding from the distal end portion of the center electrode 30 toward the combustion chamber side.

The center chip 50 corresponds to a first chip in the present embodiment. A specific shape of the center chip 50 will be described later.

The ground electrode 40 is a member formed of a nickel-based alloy containing nickel as a main component.

A shape of the ground electrode 40 is substantially prismatic.

One end portion of the ground electrode 40 is welded and fixed to the end portion 12 of the metal fitting 10 on the combustion chamber side.

As shown in FIG. 1, a portion of the end portion 12 of the metal fitting 10 to which the ground electrode 40 is fixed is a position separated from the center axis AX1 of the metal fitting 10.

A distal end 43 of the ground electrode 40 on a side opposite to the end portion fixed to the end portion 12 of the metal fitting 10 protrudes toward the combustion chamber side.

A portion of the ground electrode 40 in vicinity of the end portion 12 of the metal fitting 10, that is, a portion denoted by reference numeral 41 in FIG. 1, has its center axis (not shown) substantially parallel to the center axis AX1 of the metal fitting 10.

A portion of the ground electrode 40 on the distal end 43 side, that is, a portion denoted by reference numeral 42 in FIG. 1, has its center axis (not shown) inclined with respect to the center axis AX1 of the metal fitting 10.

Specifically, the center axis of the portion 42 is inclined so as to approach the center axis AX1 of the metal fitting 10 as it goes toward the distal end 43 side.

However, when viewed along the center axis AX1, the ground electrode 40 and the center axis AX1 do not overlap with each other.

A ground chip 60 is provided on the ground electrode 40 at a position near the distal end 43.

The ground chip 60 is a member formed of a noble metal such as platinum and has a columnar shape.

One end of the ground chip 60 is welded and fixed to a side surface of the ground electrode 40 on the center axis AX1 side.

As a result, the ground chip 60 is provided so as to protrude from a part of the ground electrode 40 toward the center chip 50 side.

Further, a center axis (not shown) of the ground chip 60 is inclined with respect to the center axis AX1 of the metal fitting 10.

The ground chip 60 corresponds to a second chip in the present embodiment.

The center chip 50 and the ground chip 60 are spaced apart from each other, and a space where spark discharge occurs is formed between them.

During the operation of the internal combustion engine, a high voltage is applied between the metal fitting 10 and the terminal 35, thereby generating a spark discharge between the center chip 50 and the ground chip 60.

The specific shape of the center chip 50 will be described with reference to FIG. 2.

Figure 2:
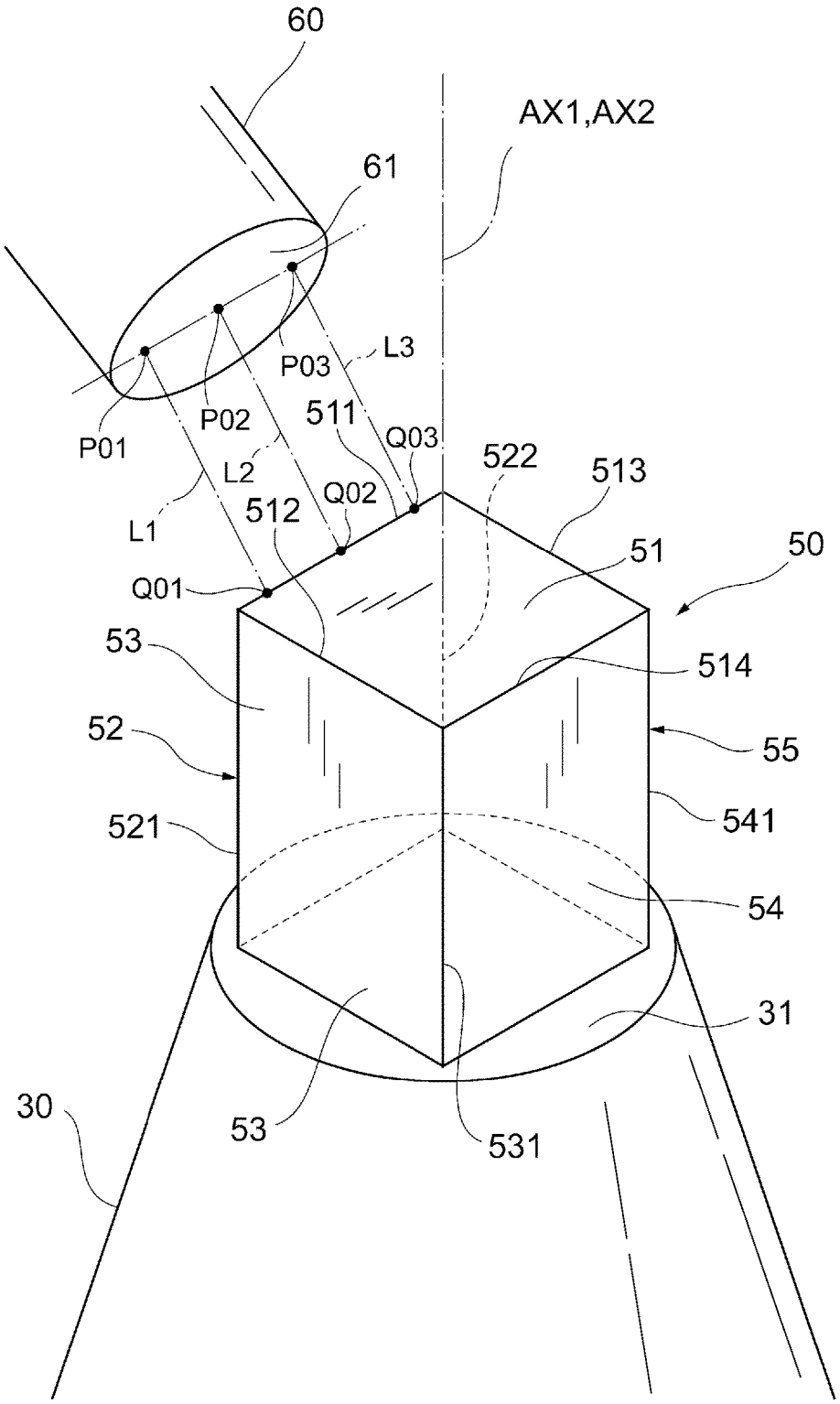
FIG. 2 shows a perspective view of a configuration of a center chip and a ground chip.

As shown in FIG. 2, the center chip 50 in the present embodiment is formed as a rectangular parallelepiped.

A distal end surface 31 of the center electrode 30 is a surface perpendicular to the center axis AX1 of the metal fitting 10.

The center chip 50 is welded and fixed to a position corresponding to a center of the distal end surface 31.

Therefore, as described above, the center axis AX2 of the center chip 50 is aligned with the center axis AX1 of the metal fitting 10.

A distal end surface 51 of the center chip 50 is a surface perpendicular to the center axis AX1.

On the other hand, a distal end surface 61 of the ground chip 60 is a surface inclined with respect to the center axis AX1.

As a result, the distal end surface 51 of the center chip 50 and the distal end surface 61 of the ground chip 60 are not parallel to each other, and both are disposed obliquely facing each other.

Compared with a configuration mentioned above with a configuration that the ground electrode 40 extends to a position where it overlaps with the center axis AX1, a space between the ground electrode 40 and the center electrode 30 is secured widely in the present embodiment.

In such a configuration, it is possible to prevent a flame kernel generated by the spark discharge from approaching the ground electrode 40 too close, thereby it is possible to prevent such a phenomenon that the flame kernel comes into contact with a surface of the ground electrode and inhibiting a growth of the flame kernel from occurring.

Further, since there is a wide space expanding from a position right above the center electrode 30 toward a direction opposite to the ground electrode 40, a path through which the spark discharge can be generated can be secured over a wide range.

Furthermore, since the length of the ground electrode 40 is relatively short in the above configuration, an effect of improving a heat dissipation ability of the ground electrode 40 is also obtained.

A portion of the center chip 50 closest to the ground chip 60, that is, a portion having the shortest distance to the ground chip 60, is a side 511 which is a part of edges of the distal end surface 51.

The center chip 50 is disposed such that the side 511 is parallel to the distal end surface 61 of the ground chip 60.

Therefore, the distance from an arbitrary point of the side 511, where the center chip 50 and the ground chip 60 are opposed, to the ground chip 60 is constant regardless of the position of the relevant point.

In other words, the distance from the side 511 to the ground chip 60 is equal at any point on the side 511.

As a result, the spark discharge between the center chip 50 and the ground chip 60 is generated starting from any point on the side 511.

A ridge line formed by such a side 511 corresponds to a discharge starting ridge line in the present embodiment.

In FIG. 2, points Q01, Q02, and Q03 are shown as examples of points on the side 511 that is on a portion where the center chip 50 faces the ground chip 60.

An imaginary line indicating the shortest path from the point Q01 to the ground chip 60 is shown as an imaginary line L1, and an intersection point of the imaginary line L1 and the distal end surface 61 is shown as a point P01.

Similarly, an imaginary line indicating the shortest path from the point Q02 to the ground chip 60 is shown as an imaginary line L2, and an intersection point of the imaginary line L2 and the distal end surface 61 is shown as a point P02.

Further, an imaginary line indicating the shortest path from the point Q03 to the ground chip 60 is shown as an imaginary line L3, and an intersection point of the imaginary line L3 and the distal end surface 61 is shown as a point P03.

All of the imaginary line L1, the imaginary line L2, and the imaginary line L3 are lines perpendicular to the side 511.

As a result of the side 511 being formed as described above in the present embodiment, the lengths of the imaginary line L1, the imaginary line L2, and the imaginary line L3 are all the same.

Such a relationship between the imaginary line L1, the imaginary line L2, and the imaginary line L3 is always established without depending on the position such as the point Q01.

Further, the relevant length corresponds to the shortest distance from the side 511 (discharge starting ridge line) to the ground chip 60 (second chip).

It should be noted that the portion where the center chip 50 faces the ground chip 60 in the side 511 is a portion on the side 511 perpendicular to the side 511, and is a portion on the side 511 where an imaginary line passing through both the side 511 and the ground chip 60 can be drawn.

In addition, a portion of the ground chip 60 that faces the side 511 does not need to be a surface as in the present embodiment (the distal end surface 61), but a ridge line (a corner portion) formed on the surface of the ground chip 60, for example, may be used.

In other words, it may be the side 511 and the ridge line formed on the surface of the ground chip 60 being opposed to each other in parallel state, and the distance between them is the shortest distance from the side 511 to the ground chip 60.

In FIG. 2, a side surface of side surfaces of the center chip 50 on the ground electrode 40 side (that is, a side surface extending from the side 511 toward the distal end surface 31 of the center electrode 30) is shown as a side surface 52.

The discharge starting ridge line (the side 511) is a straight ridge line that forms a boundary between two surfaces (the distal end surface 51 and the side surface 52) having different normal line directions in portions closest to the ground chip 60 in the center chip 50.

For convenience of description, a side surface (a side surface on a front side of FIG. 2) adjacent to the side surface 52 of the center chip 50 is shown as a side surface 53 in FIG. 2.

In addition, a side surface adjacent to the side surface 53 and located on a side opposite to the side surface 52 is shown as a side surface 54.

Further, a side surface adjacent to the side surface 52 and located on a side opposite to the side surface 53 is shown as a side surface 55.

A side 512 is a side between the distal end surface 51 and the side surface 53. A side 513 is a side between the distal end surface 51 and the side surface 55. A side 514 is a side between the distal end surface 51 and the side surface 54.

A side 521 is a side between the side surface 52 and the side surface 53. A side 522 is a side between the side surface 52 and the side surface 55. A side 531 is a side between the side surface 53 and the side surface 54. A side 541 is a side between the side surface 54 and the side surface 55.

Prior to describing effects of the center chip 50 being formed as described above, a configuration and problems of a spark plug according to a comparative example will be described with reference to FIG. 16.

The comparative example differs from the present embodiment only in that a shape of a center chip is columnar.

Hereinafter, the center chip in the comparative example will be referred to as the center chip 70.

The columnar center chip 70 is welded and fixed to a distal end surface 31 of a center electrode 30 in a state in which its center axis AX2 is aligned with a center axis AX1 of a metal fitting 10.

A distal end surface 71, which is a surface of the center chip 70 on a side opposite to a welded portion, is a surface perpendicular to the center axis AX1 of the metal fitting 10.

Therefore, similar to the embodiment shown in FIG. 2, the distal end surface 71 of the center chip 70 and a distal end surface 61 of a ground chip 60 are not parallel to each other, and both are disposed obliquely opposite to each other.

Since the distal end surface 71 of the center chip 70 is circular, a portion of the center chip 70 where the distance to the ground chip 60 is the shortest is a single point on an edge 72 of the distal end surface 71.

A point that is the closest position to the ground chip 60 as described above is shown as a point P41 in FIG. 16.

A spark discharge tends to occur starting from two points where the distance between the electrodes is the closest.

Therefore, the spark discharge in the present comparative example occurs between the distal end surface 61 of the ground chip 60 and the point P41.

Figure 16:
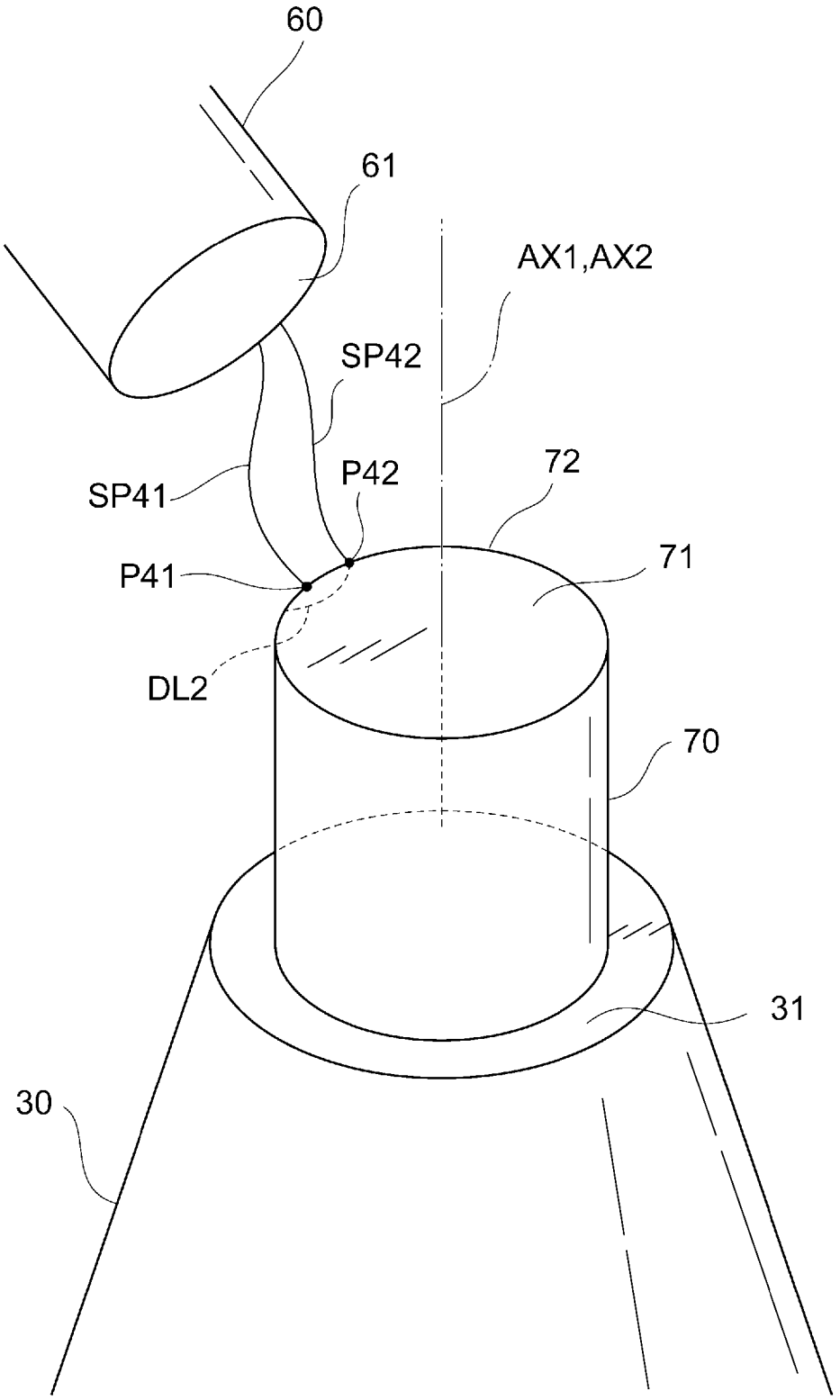
FIG. 16 shows a diagram for explaining spark discharge paths in a spark plug according to a comparative example.

An example of such a spark discharge path is shown as a discharge path SP41 in FIG. 16.

When the spark discharge starting from the point P41 is repeated, the point P41 of the center chip 70 and its vicinity are worn out by the impact of the spark discharge.

An area of wearing out of the center chip 70 as described above is indicated by a dotted line DL2 in FIG. 16.

The distance from the center chip 70 to the ground chip 60 increases when the area indicated by the dotted line DL2 is worn out.

After wearing out, a portion of the center chip 70 that is closest to the ground chip 60 becomes a point located at a boundary with the worn portion (dotted line DL2) in the edge 72.

This relevant point is shown as a point P42 in FIG. 16.

Thereafter, the spark discharge will occur starting from the point P42.

An example of a path of the spark discharge after such wearing out is shown as a discharge path SP42 In FIG. 16.

In other words, a part of the center chip 70 is worn out by the impact of spark discharge, whereby the starting point of the spark discharge changes from the point P41 to the point P42 and the path of the spark discharge changes from the discharge path SP41 to the discharge path SP42 in the present comparative example.

Even after that, intensive spark discharges at a single point on the center chip 70 and wearing out of the center chip 70 at that point are repeated, and the distance between the center chip 70 and the ground chip 60, that is, the discharge distance gradually increases.

When the discharge distance increases, the applied voltage necessary for generating the spark discharge also increases, thereby it becomes difficult to stably generate the spark discharge.

In addition, when the applied voltage necessary becomes too large, there is a concern that dielectric breakdown of the insulator 20 occurs.

The spark discharge in the present embodiment will be described with reference to FIG. 3.

Figure 3:
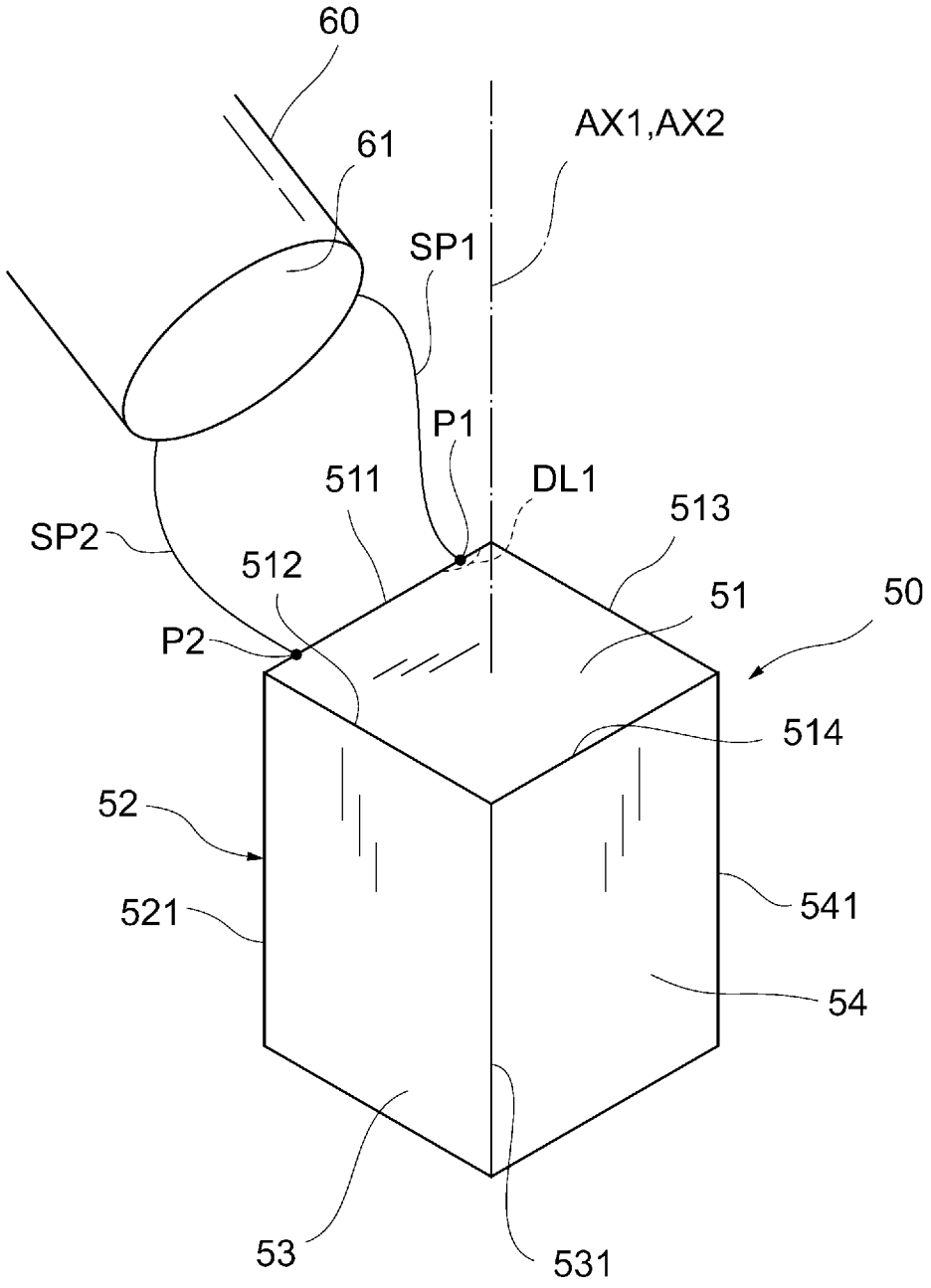
FIG. 3 shows a diagram for explaining paths of a spark discharge.

In FIG. 3, illustration of the center electrode 30 to which the center chip 50 is welded is omitted.

As described above, a portion closest to the ground chip 60 is not a specific single point but a line along the side 511 in the center chip 50 according to the present embodiment.

Before the wearing out accompanying the spark discharge occurs, an initial spark discharge occurs between any point on the side 511 and the distal end surface 61 of the ground chip 60.

An example of a point serving as a starting point of the spark discharge on the side 511 is shown as a point P1 in FIG. 3.

In addition, an example of a path of the spark discharge occurring with the point P1 as the starting point is shown as a discharge path SP1.

A wearing out of the center chip 50 occurs due to the impact of the spark discharge at the point P1 serving as the starting point of the spark discharge and in vicinity thereof, even in the present embodiment.

An area of wearing out of the center chip 50 as described above is indicated by a dotted line DL1 in FIG. 3.

The distance from the center chip 50 to the ground chip 60 increases in a worn out portion when the area indicated by the dotted line DL1 is worn out.

However, at another portion on the side 511 which is the discharge starting ridge line, while maintaining the initial distance, the distance to the distal end surface 61 of the ground chip 60 is secured as the closest part as the ridge line having a corner portion which is likely to cause electric field concentration.

For this reason, the next and subsequent spark discharges will be generated starting from a point different from the point P1 on the side 511 which is the discharge starting ridge line.

An example of a point that becomes a next starting point of the spark discharge on the side 511 is shown as a point P2 in FIG. 3.

In addition, an example of a path of the spark discharge occurring with the point P2 as the starting point is shown as a discharge path SP2.

As described above, even if the center chip 50 is worn out due to the spark discharge, the starting point of the spark discharge moves on the side 511 in the present embodiment.

Before and after a movement of the starting point, the discharge distance, which is the distance between the center chip 70 and the ground chip 60, does not change as originally.

A reason that the discharge distance changes from the original size may be that after all the points on the side 511 are worn out.

As described above, it is possible to prevent the discharge distance from being increased, and the ignition performance from being lowered accordingly, over a long period of time in the spark plug 100 according to the present embodiment.

Figure 4A:
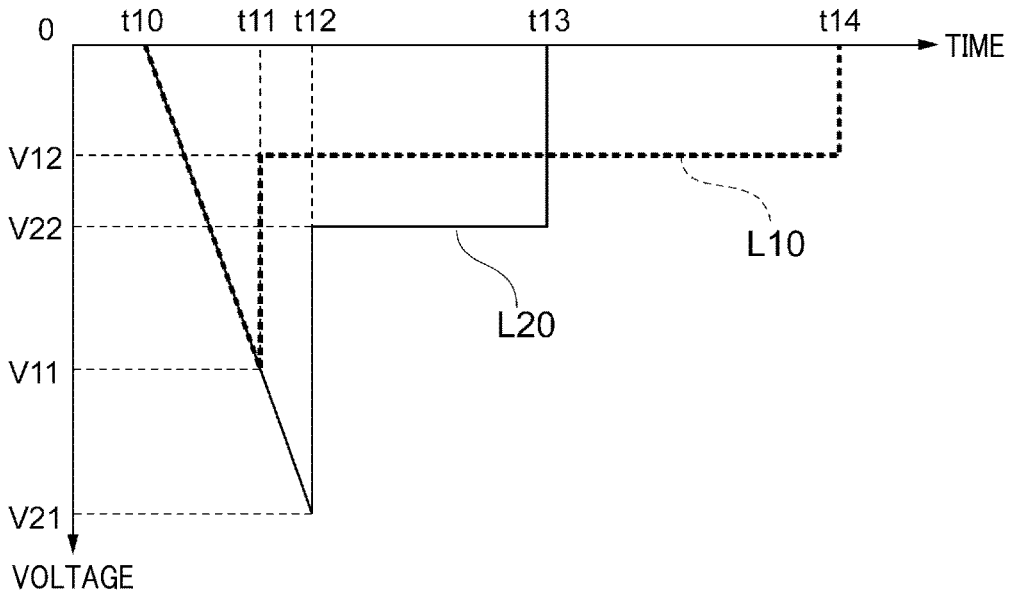
FIG. 4A shows a diagram of a voltage waveform for generating the spark discharge according to a comparative example.

FIG. 4A shows a change in a voltage applied between electrodes of the spark plug, specifically, a change in a potential at the center chip 70 in a case where the spark discharge occurs at the center chip 70 according to the comparative example.

A line L10 shown in FIG. 4A is a graph showing a change in the potential at the center chip 70 when an initial spark discharge occurs before wear of the center chip 70 occurs.

It should be noted that in a case of using the center chip 50 according to the present embodiment, an initial voltage change also has the same voltage change as shown in the line L10.

In an example indicated by the line L10, a period from time t10 to time t11 is set as a period during which the high voltage for start generating the spark discharge in the spark plug 100 is applied.

In this period, the high voltage generated in the secondary coil (not shown) of a vehicle is applied to the spark plug 100, and the potential at the center chip 70 rises abruptly.

In the example of FIG. 4A, the potential at time t11 rises to V11.

In a period (hereinafter also referred to as an induced discharge period) from the start of a discharge (hereinafter also referred to as a capacitive discharge) at time t11 to time t14, an induced voltage generated at the secondary coil is continuously applied to the spark plug 100.

Therefore, in the induced discharge period, the potential at the center chip 70 is substantially constant, and its value is V12.

The absolute value of V12 is smaller than the absolute value of V11.

When the induced discharge period ends, the spark discharge is stopped and the potential at the center chip 70 returns to 0V.

Thereafter, the capacitive discharge and the induced discharge period are repeated so as to be synchronized with the operation of the internal combustion engine.

A line L20 shown in FIG. 4A is a graph showing a change in potential at the center chip 70 when spark discharge occurs after wear of the center chip 70 has occurred at the point P41 (refer to FIG. 16).

In other words, it is a graph showing a change in the potential after the discharge distance increases as the center chip 70 wears out.

Since the applied voltage necessary increases as the discharge distance increases in the example shown by the line L20, the potential of the center chip 70 in the capacitive discharge rises to V21 having a larger absolute value than V11.

Further, the capacitive discharge started at time t10 occurs at time t12 which is after time t11.

Likewise, in the induced discharge period after the time t12, the applied voltage necessary increases as the discharge distance increases.

Therefore, the potential of the center chip 70 during the induced discharge period rises to V22, which is larger in absolute value than V12.

Further, the induced discharge period started at time t12 is completed at time t13 which is before time t14.

As described above, since the voltage waveform for generating the spark voltage changes from the line L10 to the line L20 within a short period of time in the spark plug using the center chip 70 according to the comparative example, it is difficult to generate the spark discharge stably.

This phenomenon is due to the fact that the portion of the center chip 70 closest to the ground chip 60 is the single point, as already described.

Figure 4B:
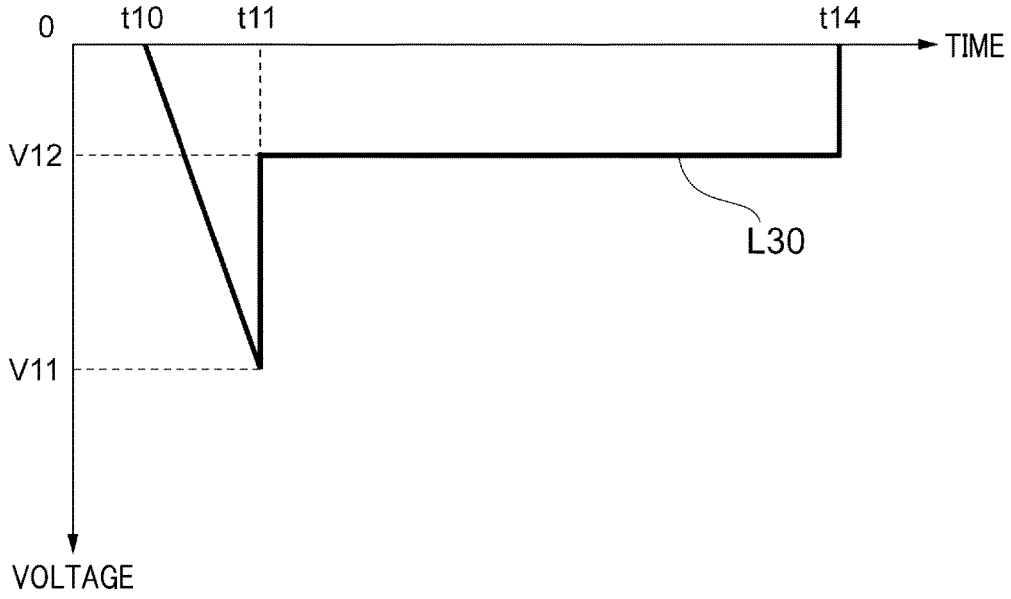
FIG. 4B shows a diagram of a voltage waveform for generating the spark discharge according to the first embodiment.

FIG. 4B shows a change in a voltage applied between electrodes of the spark plug 100, specifically, a change in a potential at the center chip 50 in a case where the spark discharge occurs in the center chip 50 according to the present embodiment.

The line L30 shown in FIG. 4B is a graph showing a change in potential at the center chip 50 when the discharge occurs after wear of the center chip 50 occurs.

As described above, the initial voltage change before wear of the center chip 50 is the same voltage change as shown in the line L10 in FIG. 4A.

In the present embodiment, even if wear of the center chip 50 occurs in a part of the side 511, the distance between the center chip 50 and the ground chip 60, that is, the discharge distance does not change as it is originally.

Therefore, the waveform of the voltage change necessary for generating the spark discharge is the same as the initial waveform shown by the line L10 in FIG. 4A even after wearing out as shown in FIG. 4B.

Accordingly, since it is not necessary to change the voltage waveform for generating the spark discharge, it is possible to stably generate the spark discharge over a long period of time in the present embodiment.

Note that after the spark discharge has started to occur between the electrodes, a path of the spark discharge varies depending on the influence of airflow in the combustion chamber and the like.

As a result, a position that becomes the starting point of the spark discharge on the surface of the center chip 50 moves from the initial position at which the spark discharge has started.

At this time, if the starting point of the spark discharge can move only on the side 511, the entire side 511 will be worn out in a relatively short period of time.

In this case, since only a part of the center chip 50 is effectively used, there is a concern that the life of the center chip 50 will be shortened.

In addition, since the spark discharge path possibly generated is restricted within a relatively narrow range, the flame kernel generated by the spark discharge may be blown out by the airflow.

Therefore, it is configured that the spark discharge starting point can be moved to a portion other than the side 511 during a period after the spark discharge has started (that is, a period during which the spark discharge is continued) in the present embodiment.

This will be explained with reference to FIG. 5.

Figure 5:
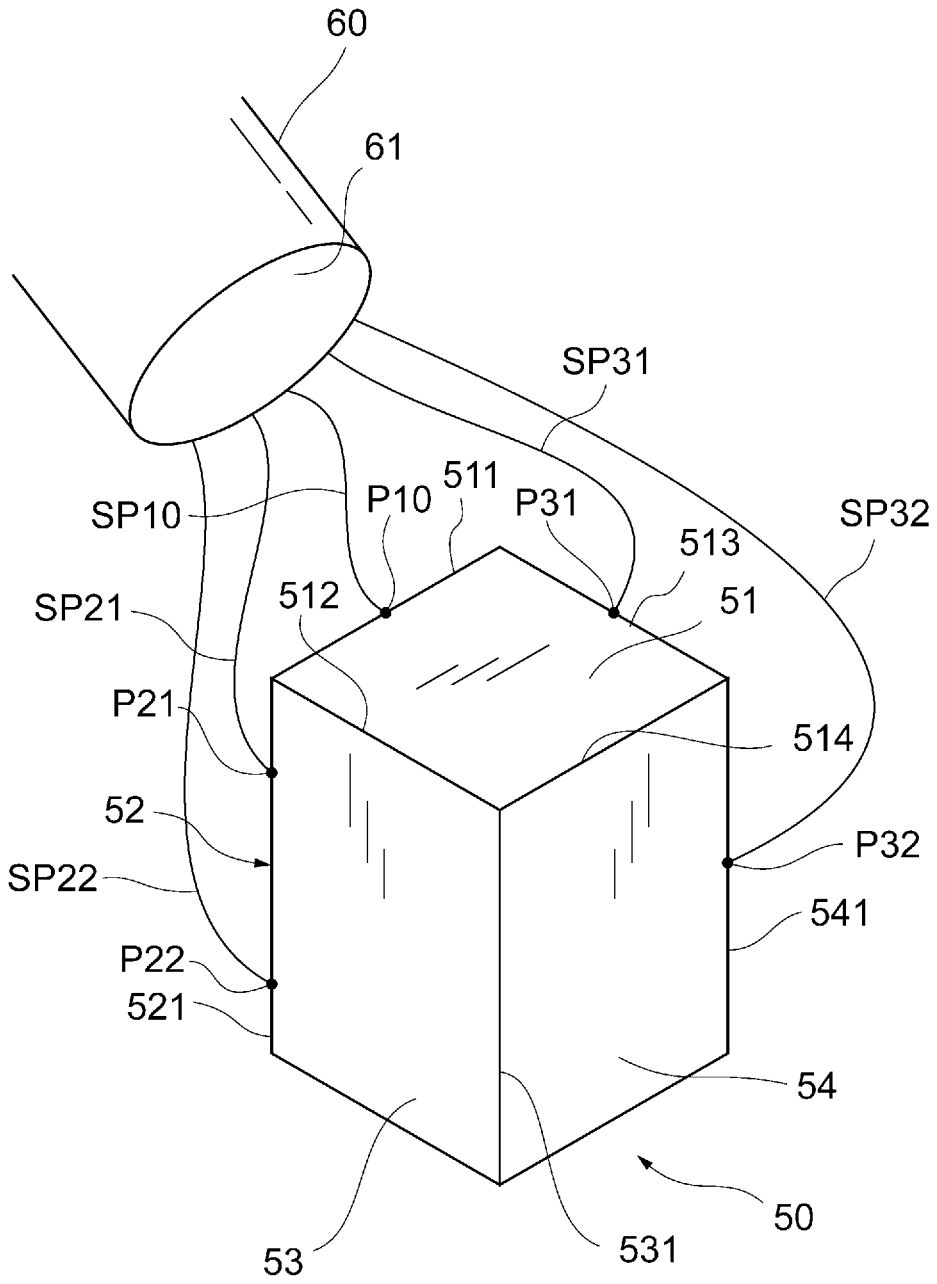
FIG. 5 shows another diagram for explaining paths of the spark discharge.

A plurality of examples of spark discharge paths that can occur between the center chip 50 and the ground chip 60 are shown in FIG. 5.

A discharge path SP10 is a discharge path starting from a point P10 on the side 511 which is the discharge starting ridge line.

This discharge path SP10 is an example of a discharge path immediately after the start of the spark discharge.

A discharge path SP21 is a discharge path starting from a point P21 at a position closer to the side 511 of the side 521.

A discharge path SP22 is a discharge path starting from a point P22 at a position closer to the center electrode 30 (not shown in FIG. 5) of the side 521. A discharge path SP31 is a discharge path starting from a point P31 on the side 513. A discharge path SP32 is a discharge path starting from a point P32 on the side 541.

In a case where there is an airflow flowing in a direction from the side 511 to the side 521 in the combustion chamber, for example, a starting point of the spark discharge moves along the side 511 and the side 521.

As a result, the path of the spark discharge changes from the discharge path SP10, to the discharge path SP21, and then to the discharge path SP22 in this order.

In addition, in a case where there is an airflow in a direction from the side 511 to the side 513 in the combustion chamber, the starting point of the spark discharge moves along the side 511, the side 513, and the side 541 which are corner portions where the electric field is concentrated.

As a result, the path of the spark discharge changes from the discharge path SP10, to the discharge path SP31, and then to the discharge path SP32 in this order.

In this manner, the starting point of the spark discharge can travel not only on the side 511 of the center chip 50 but also over a wide range such as the side 521, the side 513, the side 541, and the like.

The side 521 and the like are straight ridge lines that form boundaries between two surfaces having different normal line directions and form ridge lines formed at positions different from the discharge starting ridge line (the side 511).

These correspond to discharge maintaining ridge lines in the present embodiment.

The discharge maintaining ridge line is connected to the side 511 which is the discharge starting ridge by a corner portion where electric field concentrates directly or indirectly via another discharge maintaining ridge line.

It should be noted that the starting point of the spark discharge can also move onto the side 512, the side 514, or the like depending on a direction of the airflow in the combustion chamber.

Each of the side 521, the side 531, the side 541, the side 522 (refer to FIG. 2), the side 512, the side 513, and the side 514 corresponds to the discharge maintaining ridge line in the present embodiment.

As described above, the starting point of the spark discharge can move not only on the side 511 but also over a wide range as described above in the present embodiment.

Since a wide area of the center chip 50 is effectively used for the spark discharge, wearing out of the center chip 50 can be leveled out, and the center chip 50 can be used for a long period of time.

In addition, since there are few restrictions on possibly generated spark discharge paths, and the discharge path can move in a wide range depending on the direction of the airflow, a possibility that the flame kernels generated by the spark discharge are blown out by the airflow is reduced.

That is, the ignition performance of the spark plug 100 becomes high.

It should be noted that a direction in which the airflow exists around the center chip 50 changes depending on the state of the internal combustion engine and the mounting direction (a rotational direction) of the spark plug 100.

For this reason, it is desirable to form a plurality of discharge maintaining ridge lines over a wide range as in the present embodiment, and to secure a wide degree of freedom regarding positions and shapes of the discharge paths.

Although an example in the case that the discharge starting ridge line and the discharge maintaining ridge lines are formed in the center chip 50 in the above description, the discharge starting ridge and the discharge maintaining ridge lines may be formed not in the center chip 50 but in the ground chip 60.

That is, the ground chip 60 may be the first chip and the center chip 50 may be the second chip.

In this case, a configuration of the shape of the center chip 50 and the shape of the ground chip 60 described above may be replaced with each other.

That is, the shape of the ground chip 60 may be the same shape (quadrangular prism) as that of the center chip 50 of the present embodiment, and the shape of the center chip 50 may be the same shape (columnar) as that of the ground chip 60 of the present embodiment.

This also applies to the other embodiments described below.

Figure 6:
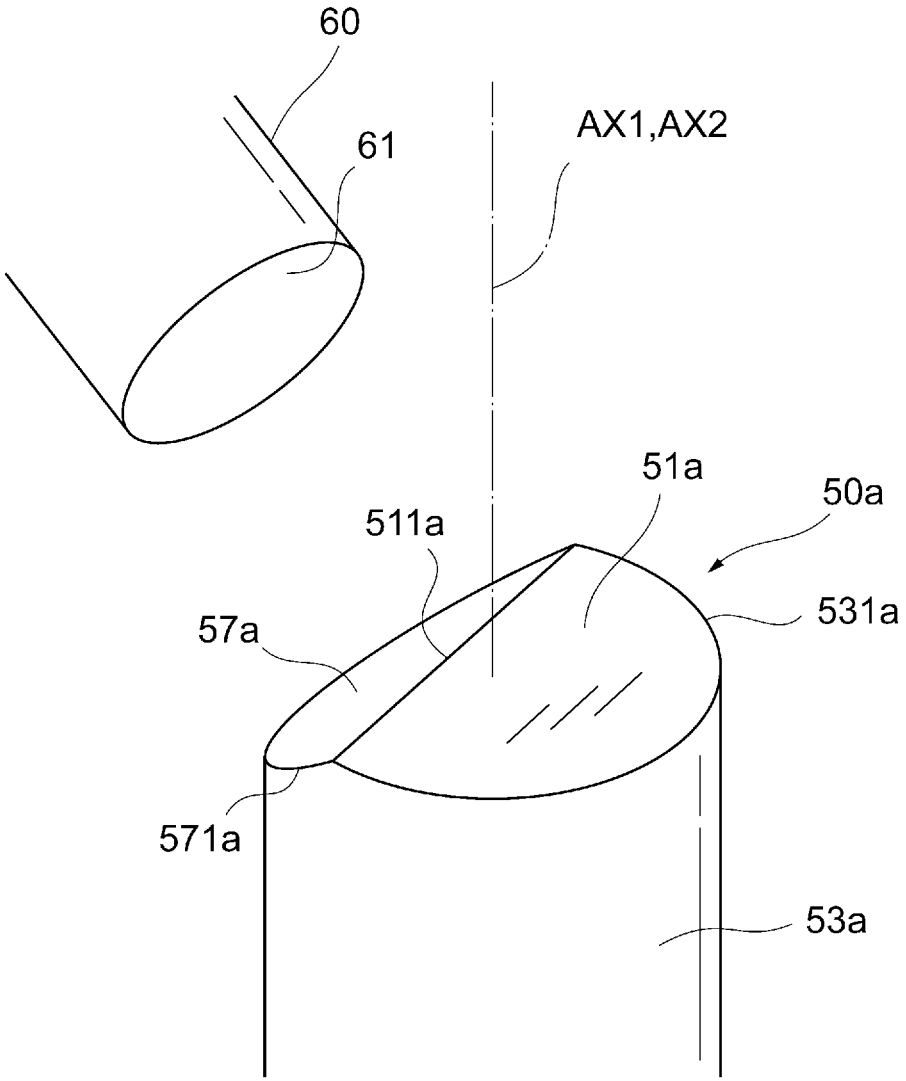
FIG. 6 shows a perspective view of a configuration of a center chip and a ground chip in a spark plug according to a second embodiment of the present disclosure.

A second embodiment will be described with reference to FIG. 6.

A spark plug 100 according to the second embodiment differs from the first embodiment only in a shape of a center chip 50*a*, and other configurations are the same as those in the first embodiment.

Hereinafter, only points different from the first embodiment will be described, and description common to the first embodiment will be omitted.

A shape of the center chip 50*a* according to the present embodiment has a columnar shape similar to that of the comparative example of FIG. 16, and has a shape such that a part of a distal end surface 51*a* thereof is obliquely cut.

An edge of the distal end surface 51*a* is composed of an edge 531*a* which is an arcuate portion and an edge 511*a* which is a linear portion.

The edge 511*a* is a linearly formed portion formed between a surface 57*a* formed by obliquely cutting the distal end surface 51*a* and the distal end surface 51*a*.

The center chip 50*a* is welded and fixed to a distal end surface 31 (not shown in FIG. 6) of a center electrode 30 in a state in which its center axis AX2 is aligned with a center axis AX1 of a metal fitting 10.

A portion of the center chip 50*a* having the shortest distance to a ground chip 60 is an edge 511*a*.

The center chip 50*a* is disposed such that the edge 511*a* is parallel to a distal end surface 61 of the ground chip 60.

Therefore, the distance from an arbitrary point on the edge 511*a* to the ground chip 60 is constant regardless of the position of the point.

In other words, the edge 511*a* and the surface 57*a* are formed such that the distance from the edge 511*a* to the ground chip 60 is equal in a portion where the center chip 50*a* (a first chip) and the ground chip 60 (a second chip) face each other.

As a result, the spark discharge between the center chip 50*a* and the ground chip 60 is generated starting from any point on the edge 511*a*.

A ridge line formed by the edge 511*a* is a straight ridge line that forms a boundary between two surfaces (the distal end surface 51*a* and the surface 57*a*) having different normal line directions, and corresponds to a discharge starting ridge line in the present embodiment.

Even in such a configuration, the discharge distance is prevented from increasing within a short period of time as in the first embodiment.

It should be noted that a range in which the starting point of the spark discharge can move is limited to the edge 511*a*, the edge 531*a*, and an edge 571*a* which is an edge of the surface 57*a* in the present embodiment.

The edge 531*a* and the edge 571*a* are ridge lines that form a boundary between two surfaces having different normal line directions, and both form ridge lines connected to the edge 511*a*.

These ridge lines correspond to discharge maintaining ridge lines in the present embodiment.

However, these discharge maintaining ridge lines are not formed over a wide range along a side surface 53*a* of the center chip 50*a*, but are formed only in a relatively narrow range in the vicinity of the distal end surface 51*a*.

Regarding an effect of ensuring a wide range in which the starting point of the spark discharge can be moved, the first embodiment in which the discharge maintaining ridge lines (the sides 521 and the like) are also formed in the direction along the center axis AX2 can show a larger effect.

Figure 7A:
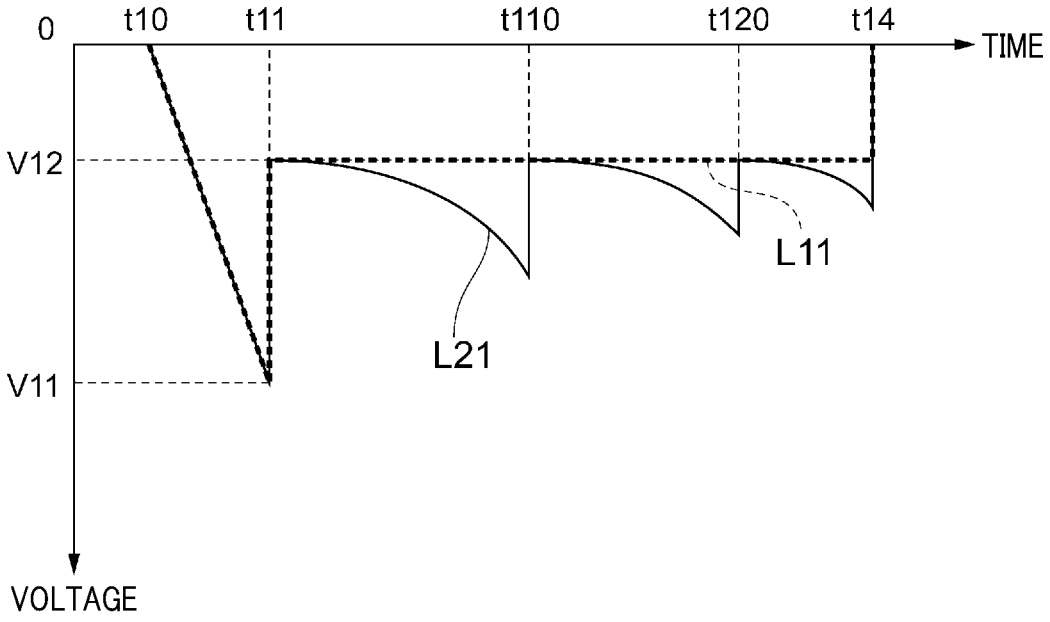
FIG. 7A shows a diagram of a voltage waveform for generating the spark discharge according to the second embodiment.

FIG. 7A shows the change in a voltage applied between electrodes of the spark plug 100, specifically, a change in a potential at the center chip 50*a* in a case where the spark discharge occurs in the center chip 50*a*.

A line L11 shown in FIG. 7A is a graph showing a change in potential at the center chip 50*a* in a case where the flow velocity of airflow in a combustion chamber is relatively small.

The graph is the same as the graph shown on the line L10 in FIG. 4A and the line L30 in FIG. 4B.

Since the flame kernel is not blown out when the flow velocity of the airflow in the combustion chamber is small as shown by line L11, the potential of the center chip 50*a* is substantially constant (V12) in an induced discharge period after time t11.

A line L21 shown in FIG. 7A is a graph showing a change in potential at the center chip 50*a* in a case where the flow velocity of the airflow in the combustion chamber is relatively large.

In an example indicated by the line L21, the flame kernel is blown out by the high-speed airflow at each of time t110 and time t120 which is after time t11.

Therefore, at time t110 or the like, a large voltage is applied again between the electrodes for re-ignition.

Such blowout of the flame kernel is caused by a fact that the starting point of the spark discharge can move only in a relatively narrow range and the discharge path cannot move to an appropriate position according to the airflow.

Figure 7B:
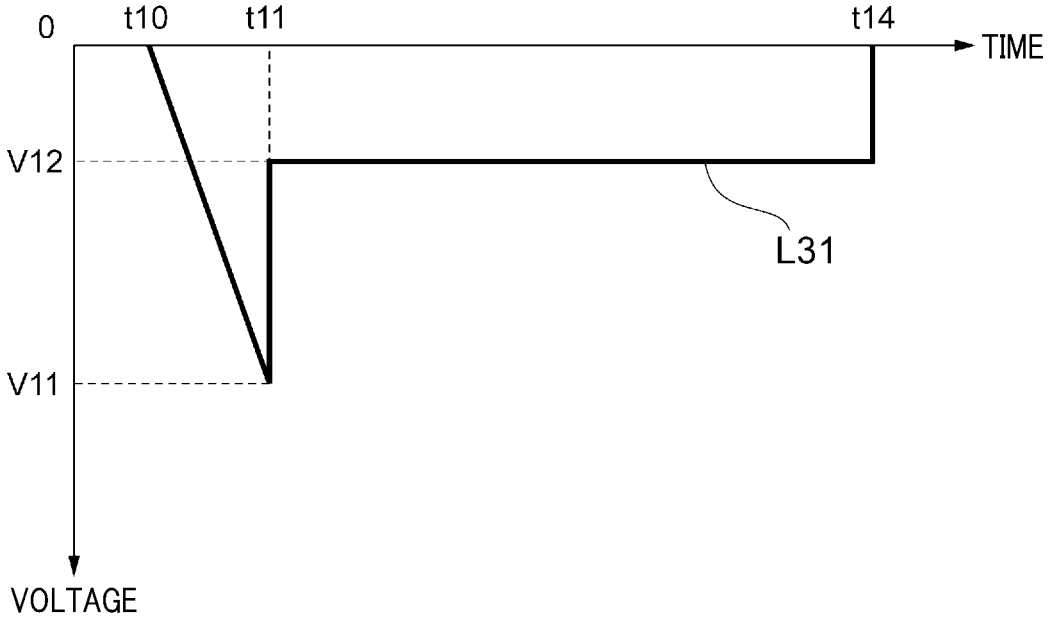
FIG. 7B shows another diagram of a voltage waveform for generating the spark discharge according to the first embodiment.

FIG. 7B shows a change in a voltage applied between the electrodes of the spark plug 100, specifically, the change in the voltage at the center chip 50 in a case where the spark discharge occurs in the center chip 50 according to the first embodiment described above is shown.

A line L31 shown in FIG. 7B is a graph showing a change in potential at the center chip 50 in a case where the flow velocity of the airflow in the combustion chamber is relatively large.

The graph is the same as the graph shown on the line L10 in FIG. 4A and the line L30 in FIG. 4B.

In the center chip 50 according to the first embodiment, the flame kernel is maintained without being blown out even if the flow velocity of the airflow in the combustion chamber is large, and the potential of the center chip 50 is substantially constant (V12).

This is because that the starting point of the spark discharge can move in a relatively wide range, so that the discharge path moves so as to have an appropriate position and shape depending on the airflow.

As described above, it is desirable that the ridge lines formed in the center chip 50 are formed over a wide range on the surface of the center chip 50, and it is further desirable that the ridge lines are also formed in the direction along the center axis AX2 on the side surface of the center chip 50.

A third embodiment will be described with reference to FIG. 8.

A spark plug 100 according to the third embodiment differs from the first embodiment only in a shape of a center chip 50*b*, and the other configurations are the same as those in the first embodiment.

Hereinafter, only points different from the first embodiment will be described, and description common to the first embodiment will be omitted.

A shape of a center chip 50*b* according to the present embodiment is a triangular prism.

The center chip 50*b* is welded and fixed to a distal end surface 31 (not shown in FIG. 8) of a center electrode 30 in a state in which its center axis AX2 is aligned with a center axis AX1 of a metal fitting 10.

A shape of a distal end surface 51*b* of the center chip 50*b* is an isosceles triangle.

The length of a side 513*b* and the length of a side 512*b* among three sides that are edges of the distal end surface 51*b* are equal to each other.

The length of the remaining side 511*b* is longer than the length of the side 513*b* and the like.

That is, the side 511*b* is one of a plurality of sides possessed by the distal end surface 51*b*, and is the longest side among the plurality of sides.

A portion of the center chip 50*b* having the shortest distance to a ground chip 60 (not shown in FIG. 8) is a side 511*b* which is a part of edges of the distal end surface 51*b*.

The center chip 50*b* is disposed so that the side 511*b* is parallel to a distal end surface 61 of the ground chip 60.

Therefore, the distance from an arbitrary point on the side 511*b* to the ground chip 60 is constant regardless of the position of the relevant point.

In other words, the distance from the side 511*b* to the ground chip 60 is equal at a portion where the center chip 50*b* (the first chip) and the ground chip 60 (the second chip) face each other.

As a result, the spark discharge between the center chip 50*b* and the ground chip 60 is generated starting from any one point on the side 511*b*.

A ridge line formed by such a side 511*b* corresponds to a discharge starting ridge line in the present embodiment.

Effects of the discharge starting ridge line are the same as the effects described in the first embodiment.

The side 511*b* of the discharge starting ridge line is the longest side among the plurality of sides of the distal end surface 51*b* in the present embodiment.

As a result, since a wide range where spark discharge can occur initially is secured, the center chip 50*b* can be used for a longer period of time.

Figure 8:
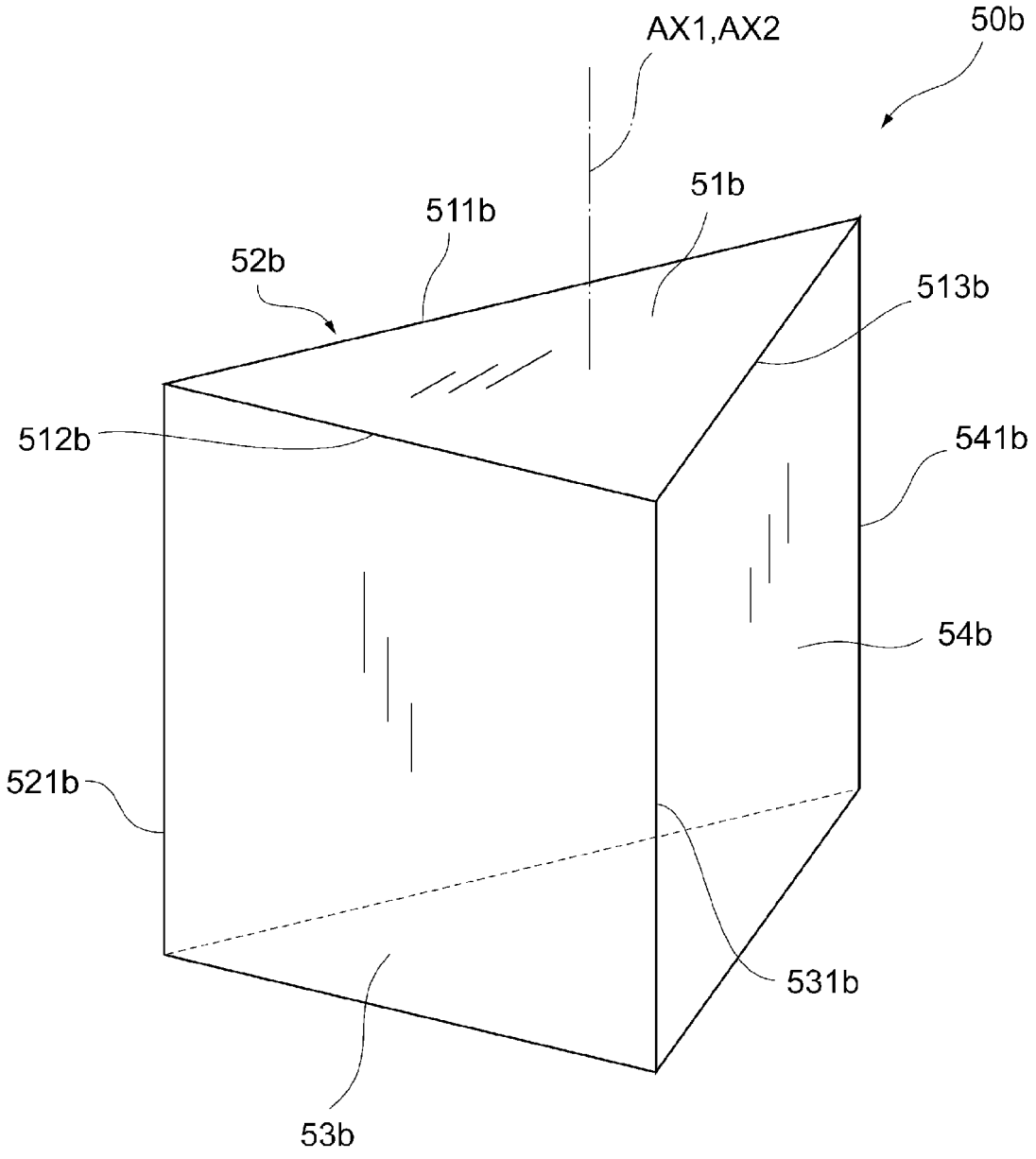
FIG. 8 shows a perspective view of a configuration of a center chip in a spark plug according to a third embodiment of the present disclosure.

A side surface of the center chip 50*b* extending from the side 511*b* toward the center electrode 30 (not shown in FIG. 8) is shown as a side surface 52*b* in FIG. 8.

Further, a side surface extending from the side 512*b* toward the center electrode 30 is shown as a side surface 53*b*.

Furthermore, a side surface extending from the side 513*b* toward the center electrode 30 is shown as a side surface 54*b*.

A side 521*b* is a side between the side surface 52*b* and the side surface 53*b*. A side 531*b* is a side between the side surface 53*b* and the side surface 54*b*. A side 541*b* is a side between the side surface 52*b* and the side surface 54*b*.

Each of the side 512*b*, the side 513*b*, the side 521*b*, the side 531*b*, and the side 541*b* is a straight ridge line that forms a boundary between two surfaces having different normal line directions, thereby forming ridge lines formed at different positions with respect to the discharge starting ridge line (the side 511*b*).

These sides correspond to discharge maintaining ridge lines in the present embodiment.

The discharge maintaining ridge line is connected to the side 511*b* which is the discharge starting ridge line directly or indirectly via another discharge maintaining ridge line.

Effects of the discharge starting ridge line are the same as the effects described in the first embodiment.

A fourth embodiment will be described with reference to FIG. 9.

A spark plug 100 according to the fourth embodiment differs from the first embodiment only in a shape of a center chip 50*c*, and other configurations are the same as those in the first embodiment.

Hereinafter, only points different from the first embodiment will be described, and description common to the first embodiment will be omitted.

A shape of a center chip 50*c* according to the present embodiment is a hexagonal prism.

The center chip 50*c* is welded and fixed to a distal end surface 31 (not shown in FIG. 9) of a center electrode 30 in a state in which its center axis AX2 is aligned with a center axis AX1 of a metal fitting 10.

A shape of a distal end surface 51*c* of the center chip 50*c* is hexagonal.

The lengths of five sides 531*c* excluding a side 511*c* among six sides that are edges of the distal end surface 51*c* are equal to each other.

In addition, the length of the remaining side 511*c* is longer than the lengths of the other sides 531*c*.

That is, the side 511*c* is one of a plurality of sides possessed by the distal end surface 51*c*, and is the longest side among the plurality of sides.

Figure 9:
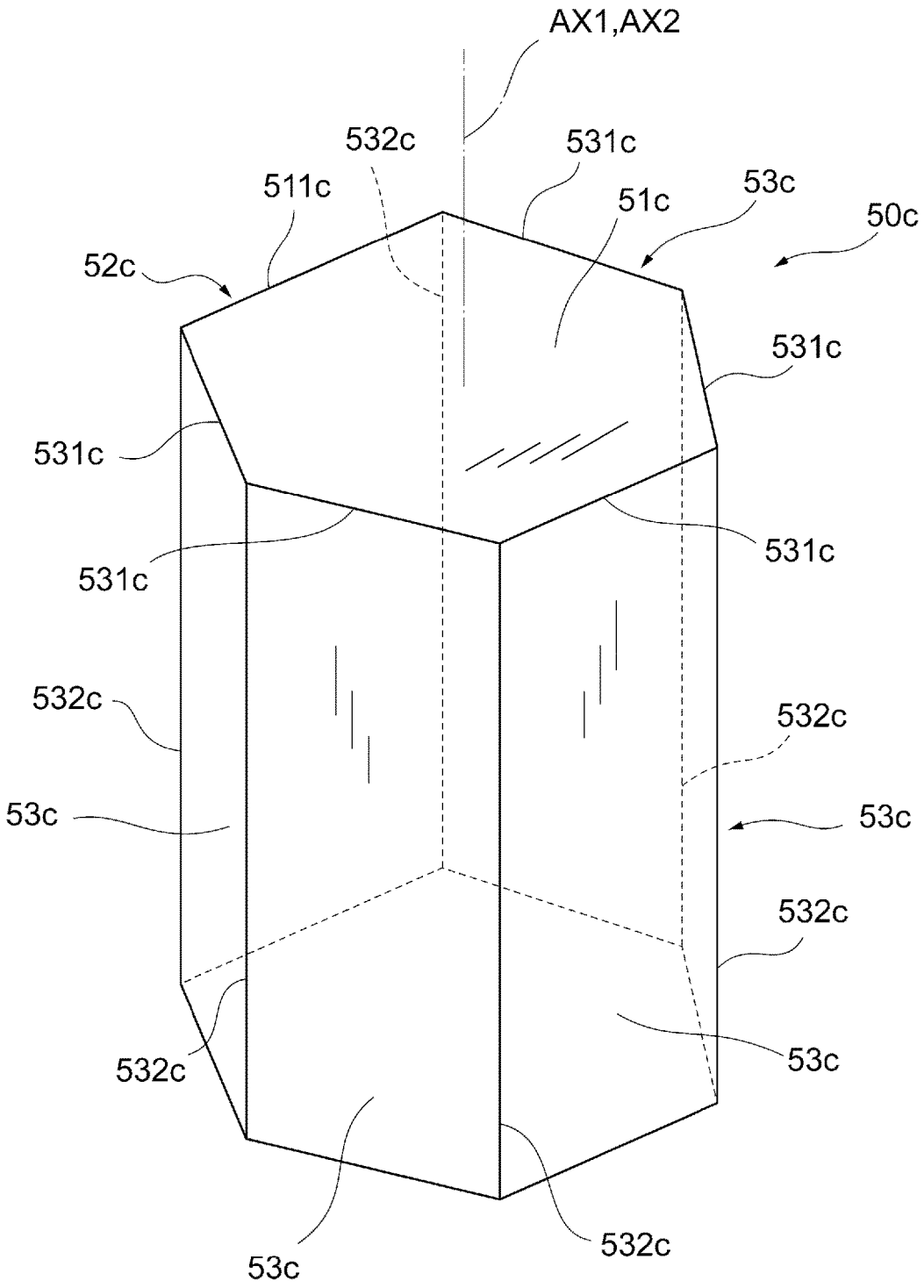
FIG. 9 shows a perspective view of a configuration of a center chip in a spark plug according to a fourth embodiment of the present disclosure.

Each side surface extending from the five sides 531*c* of the center chip 50*c* toward a center electrode 30 (not shown in FIG. 9) is shown as a side surface 53*c* in FIG. 9.

A side surface extending from the side 511*c* toward the center electrode 30 is shown as a side surface 52*c*.

Furthermore, sides between the side surfaces 53*c* adjacent to each other and sides between the side surfaces 52*c* and the side surfaces 53*c* adjacent to each other are shown as sides 532*c*.

There are six such sides 532*c* in total.

A portion of the center chip 50*c* having the shortest distance to a ground chip 60 (not shown in FIG. 9) is a side 511*c* which is a part of edges of the distal end surface 51*c*.

The center chip 50*c* is disposed such that the side 511*c* is parallel to a distal end surface 61 of the ground chip 60.

Therefore, the distance from an arbitrary point on the side 511*c* to the ground chip 60 is constant regardless of the position of the point.

In other words, the distance from the side 511*c* to the ground chip 60 is equal in a portion where the center chip 50*c* (a first chip) and the ground chip 60 (a second chip) face each other.

As a result, the spark discharge between the center chip 50*c* and the ground chip 60 is generated starting from any point on the side 511*c*.

A ridge line formed by the side 511*c* is a straight ridge line that forms a boundary between two surfaces (the distal end surface 51*c* and the side surface 52*c*) having different normal line directions, and corresponds to a discharge starting ridge in the present embodiment.

Effects when the discharge starting ridge line is provided are the same as the effects described in the first embodiment.

As in the second embodiment, the side 511*c* of the discharge starting ridge line is the longest side among the plurality of sides of the distal end surface 51*c* in the present embodiment as well.

As a result, since a wide range where spark discharge can occur initially is secured, the center chip 50*c* can be used for a longer period of time.

Each of the five sides 531*c* and the six sides 532*c* is a straight ridge line that forms a boundary between two surfaces having different normal line directions, thereby forming ridge lines formed at different positions with respect to the discharge starting ridge line (the side 511*c*).

These sides correspond to discharge maintaining ridge lines in the present embodiment.

The discharge maintaining ridge line is connected to the side 511*c* which is the discharge starting ridge line directly or indirectly via another discharge maintaining ridge line.

Effects of the discharge starting ridge line are the same as the effects described in the first embodiment.

The shape of the center chip may be a quadrangular prism (rectangular parallelepiped) as in the first embodiment, a triangular prism as in the third embodiment, or a hexagonal prism as in the present embodiment.

The shape of the center chip may be a polygonal prism other than the above (for example, an octagonal prism having an octagonal shape at a distal end surface).

A fifth embodiment will be described with reference to FIG. 10.

A spark plug 100 according to the fifth embodiment differs from the first embodiment only in a shape of a center chip 50*d*, and the other configurations are the same as those in the first embodiment.

Hereinafter, only points different from the first embodiment will be described, and description common to the first embodiment will be omitted.

A shape of the center chip 50*d* according to the present embodiment is formed in a columnar shape as in the comparative example of FIG. 16, and a part of which is cut along a plane parallel to a center axis of the column.

An edge of a distal end surface 51*d* is composed of an edge 531*d* which is an arcuate portion and an edge 511*d* which is a linear portion.

Reference numeral 511*d* is a portion to be a straight ridge formed between the distal end surface 51*d* and a side surface 52*d* formed by cutting the column along the plane parallel to a center axis AX2.

The center chip 50*d* is welded and fixed to a distal end surface 31 (not shown in FIG. 10) of a center electrode 30 in a state in which its center axis AX2 is aligned with a center axis AX1 of a metal fitting 10.

A portion of the center chip 50*d* having the shortest distance to a ground chip 60 (not shown in FIG. 10) is an edge 511*d* which is a part of edges of the distal end surface 51*d*.

The center chip 50*d* is disposed such that the edge 511*d* is parallel to a distal end surface 61 of the ground chip 60.

Therefore, the distance from an arbitrary point on the edge 511*d* to the ground chip 60 is constant regardless of the position of the point.

In other words, the distance from the edge 511*d* to the ground chip 60 is equal in a portion where the center chip 50*d* (a first chip) and the ground chip 60 (a second chip) face each other.

As a result, the spark discharge between the center chip 50*d* and the ground chip 60 is generated starting from any point on the edge 511*d*.

A ridge line formed by the edge 511*d* is a straight ridge line that forms a boundary between two surfaces (the distal end surface 51*d* and the side surface 52*d*) having different normal line directions, and corresponds to a discharge starting ridge line in the present embodiment.

Effects of the discharge starting ridge line are the same as the effects described in the first embodiment.

Figure 10:
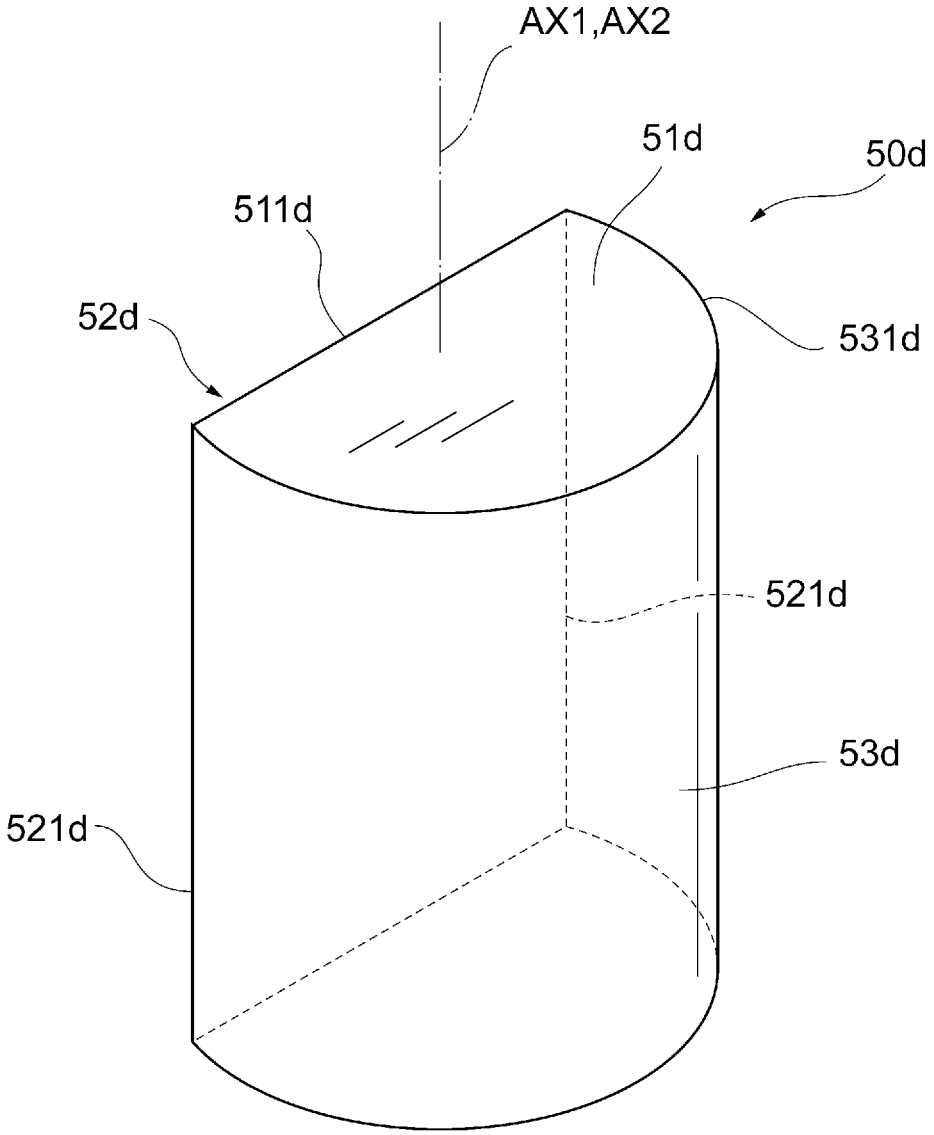
FIG. 10 shows a perspective view of a configuration of a center chip in a spark plug according to a fifth embodiment of the present disclosure.

Each side (there exist two sides) between the side surface 53*d* and the side surface 52*d* adjacent to each other in the center chip 50*d* is shown as a side 521*d* in FIG. 10.

Each of the side 521*d* and the edge 531*d* is a straight ridge line that forms a boundary between two surfaces having different normal line directions and forms a ridge line formed at a position different from the discharge starting ridge line (the edge 511*d*).

These correspond to discharge maintaining ridge lines in the present embodiment.

The discharge maintaining ridge line is directly connected to the edge 511*d* which is the discharge starting ridge line.

Effects of the discharge starting ridge line are the same as the effects described in the first embodiment.

A sixth embodiment will be described with reference to FIG. 11.

A spark plug 100 according to the sixth embodiment differs from the first embodiment only in a shape of a center chip 50*e*, and other configurations are the same as those in the first embodiment.

Hereinafter, only points different from the first embodiment will be described, and description common to the first embodiment will be omitted.

A shape of the center chip 50*e* according to the present embodiment is a quadrangular prism (rectangular parallelepiped) similar to that of the first embodiment, and has a shape in which a cut groove 56*e* is formed in a part of the quadrangular prism.

Figure 11:
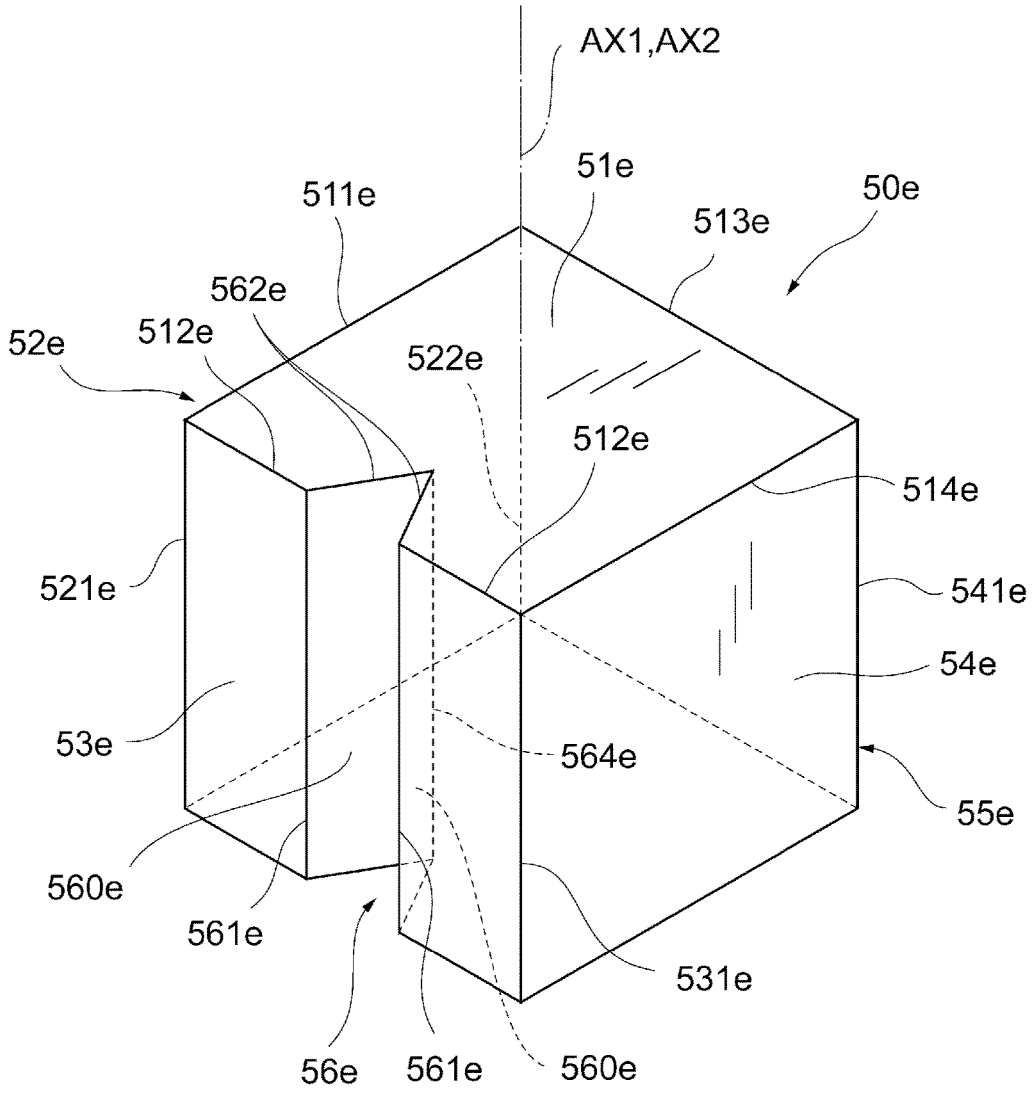
FIG. 11 shows a perspective view of a configuration of a center chip in a spark plug according to a sixth embodiment of the present disclosure.

It should be appreciated that reference numerals are added to elements of the center chip 50*e*, with the suffix e at the end of the reference numerals attached to the corresponding elements in the center chip 50 (refer to FIG. 2) in FIG. 11.

For example, a side corresponding to the side 511 of the center chip 50*e* of the first embodiment is denoted by reference numeral 511*e*. In the following description, the side is referred to as side 511*e*. The same applies to other elements.

The center chip 50*e* is welded and fixed to a distal end surface 31 (not shown in FIG. 11) of a center electrode 30 in a state in which its center axis AX2 is aligned with a center axis AX1 of a metal fitting 10.

The cut groove 56*e* is a concave groove having a V-shaped cross section, and is formed on a side surface 53*e* of the center chip 50*e*.

The cut groove 56*e* is formed as a linear groove defined by two surfaces 560*e*.

A direction in which the cut groove 56*e* extends is a direction parallel to the center axis AX2.

Since the cut groove 56*e* is formed, a side 512*e* is divided into two.

Two sides 562*e* are formed at this divided position.

Each side 562*e* is a side formed between a distal end surface 51*e* and the surface 560*e*.

A ridge line formed along the side 562*e* is a ridge line that forms a boundary between the surface 560*e* which is an inner surface of the cut groove 56*e* and the distal end surface 51*e* which is a surface of the center chip 50*e*.

A linear side 564*e* is formed at a bottom of the cut groove 56*e*, that is, at a portion between the two adjacent surfaces 560*e*.

In addition, a side 561*e* is formed between the surface 560*e* and the side surface 53*e*.

A ridge line formed along the side 561*e* is a ridge line that forms a boundary between the surface 560*e* which is the inner surface of the cut groove 56*e* and the side surface 53*e* which is a surface of the center chip 50*e*.

A portion of the center chip 50*e* having the shortest distance to a ground chip 60 (not shown in FIG. 11) is a side 511*e* which is a part of edges of the distal end surface 51*e*.

The center chip 50*e* is disposed such that the side 511*e* is parallel to a distal end surface 61 of the ground chip 60.

Therefore, the distance from an arbitrary point on the side 511*e* to the ground chip 60 is constant regardless of the position of the point.

In other words, the distance from the side 511*e* to the ground chip 60 is equal in a portion where the center chip 50*e* (a first chip) and the ground chip 60 (a second chip) face each other.

As a result, the spark discharge between the center chip 50*e* and the ground chip 60 is generated starting from any point on the side 511*e*.

A ridge line formed by the side 511*e* is a straight ridge line that forms a boundary between two surfaces (the distal end surface 51*e* and the side surface 52*e*) having different normal line directions, and corresponds to a discharge starting ridge in the present embodiment.

Effects of the discharge starting ridge line are the same as the effects described in the first embodiment.

As in the first embodiment, each of the side 521*e*, the side 522*e*, the side 531*e*, the side 541*e*, the side 512*e*, the side 513*e*, and the side 514*e* corresponds to the discharge maintaining ridge line in the present embodiment.

Effects of these discharge maintaining ridge lines are the same as the effects described in the first embodiment.

Furthermore, each of the side 564*e*, the two sides 561*e*, and the two sides 562*e* formed by the cut groove 56*e* also functions as a discharge maintaining ridge line in the present embodiment.

That is, the number of discharge maintaining ridge lines by the cut groove 56*e* being formed is increased more than the case of the first embodiment, and secures a wider degree of freedom regarding positions and shapes of the discharge paths in the present embodiment.

It should be noted that a plurality of cut grooves 56*e* may be formed.

Further, the cut groove 56*e* may be formed on a surface of the center chip 50*e* other than the side surface 53*e*.

Figure 12:
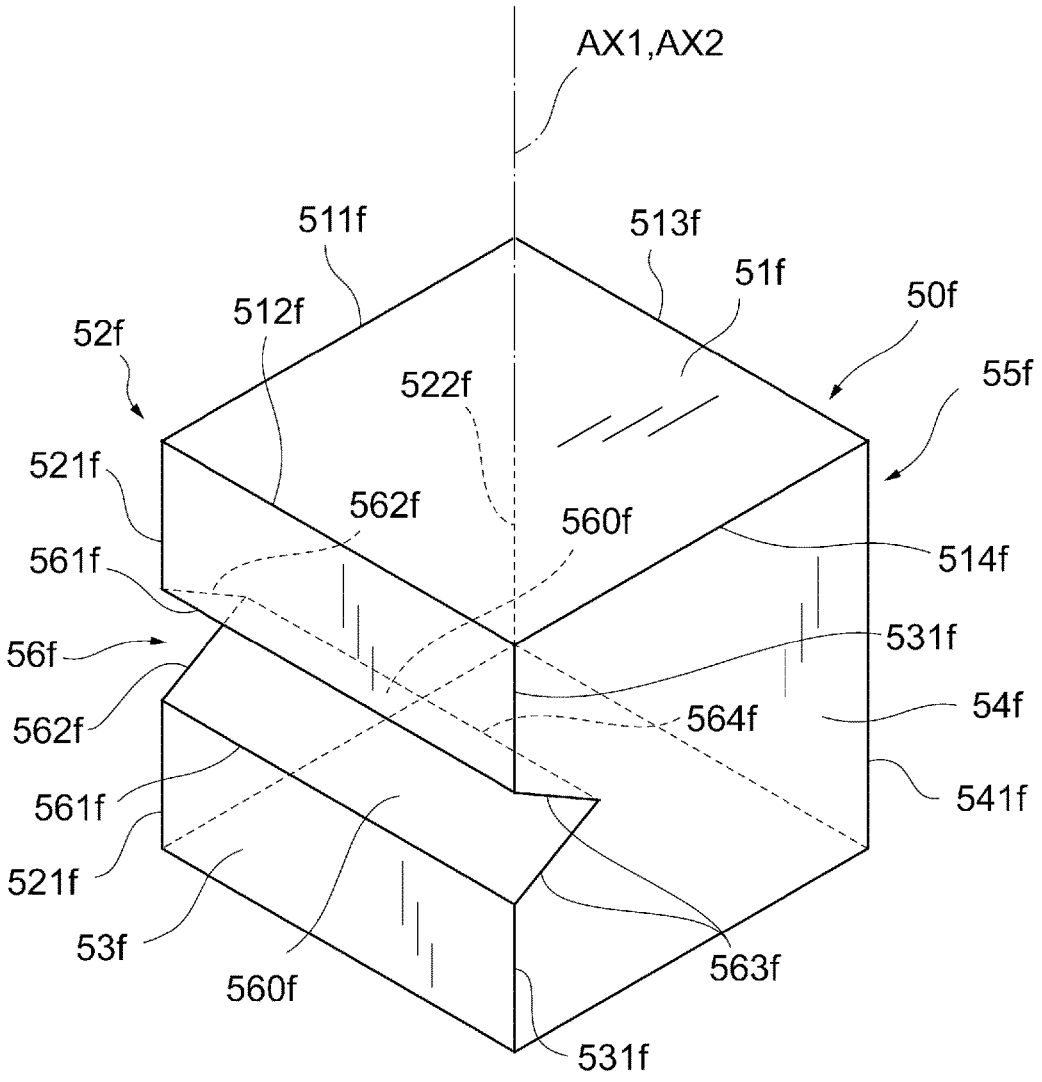
FIG. 12 shows a perspective view of a configuration of a center chip in a spark plug according to a seventh embodiment of the present disclosure.

A seventh embodiment will be described with reference to FIG. 12.

A spark plug 100 according to the seventh embodiment differs from the first embodiment only in a shape of a center chip 50*e*, and other configurations are the same as those in the first embodiment.

Hereinafter, only points different from the first embodiment will be described, and description common to the first embodiment will be omitted.

A shape of the center chip 50*f* according to the present embodiment is a quadrangular prism (rectangular parallelepiped) similar to that of the first embodiment, and has a shape in which a cut groove 56*f* is formed in a part of the quadrangular prism.

It should be appreciated that reference numerals are added to elements of the center chip f, with the suffix f at the end of the reference numerals attached to the corresponding elements in the center chip 50 (refer to FIG. 2) in FIG. 2.

For example, a side corresponding to the side 511 of the center chip 50*e* of the first embodiment is denoted by reference numeral 511*f*. In the following description, the side is referred to as side 511*f*. The same applies to other elements.

The center chip 50*f* is welded and fixed to a distal end surface 31 (not shown in FIG. 12) of a center electrode 30 in a state in which its center axis AX2 is aligned with a center axis AX1 of a metal fitting 10.

The cut groove 56*f* is a concave groove having a V-shaped cross section similar to the cut groove 56*e* in the sixth embodiment, and is formed on a side surface 53*f* of the center chip 50*f*.

The cut groove 56*f* is formed as a linear groove defined by two surfaces 560*f*.

A direction in which the cut groove 56*f* extends is a direction perpendicular to the center axis AX2.

Since the cut groove 56*f* is formed, each of a side 521*f* and a side 531*f* is divided into two.

Two sides 562*f* are formed at a divided position of the side 521*f*.

Each side 562*f* is a side formed between a side surface 52*f* and a surface 560*f*.

A ridge line formed along the side 562*f* is a ridge line that forms a boundary between the surface 560*f* which is an inner surface of the cut groove 56*f* and the side surface 52*f* which is a surface of the center chip 50*e*.

In addition, two sides 563*f* are formed at the divided position of the side 531*f*.

Each side 563*f* is a side formed between the side surface 54*f* and the surface 560*f*.

A ridge line formed along the side 562*f* is a ridge line that forms a boundary between the surface 560*f* which is an inner surface of the cut groove 56*f* and a side surface 54*f* which is a surface of the center chip 50*f*.

A linear side 564*f* is formed at a bottom of the cut groove 56*f*, that is, at a portion between the two adjacent surfaces 560*f*.

In addition, a side 561*f* is formed between the surface 560*f* and the side surface 53*f*.

A ridge line formed along the side 561*f* is a ridge line that forms a boundary between the surface 560*f* which is the inner surface of the cut groove 56*f* and the side surface 53*f* which is a surface of the center chip 50*f*.

A portion of the center chip 50*f* having the shortest distance to a ground chip 60 (not shown in FIG. 12) is a side 511*f* which is a part of edges of the distal end surface 51*f*.

The center chip 50*f* is disposed such that the side 511*f* is parallel to a distal end surface 61 of the ground chip 60.

Therefore, the distance from an arbitrary point on the side 511*f* to the ground chip 60 is constant regardless of the position of the point.

In other words, the distance from the side 511*f* to the ground chip 60 is equal at any point on the side 511*f*.

As a result, the spark discharge between the center chip 50*f* and the ground chip 60 is generated starting from any point on the side 511*f*.

A ridge line formed by the edge 511*f* is a straight ridge line that forms a boundary between two surfaces (the distal end surface 51*f* and the side surface 52*f*) having different normal line directions, and corresponds to a discharge starting ridge line in the present embodiment.

Effects of the discharge starting ridge line are the same as the effects described in the first embodiment.

As in the first embodiment, each of the side 521*f*, the side 522*f*, the side 531*f*, the side 541*f*, the side 512*f*, the side 513*f*, and the side 514*f* corresponds to the discharge maintaining ridge line in the present embodiment.

Effects of these discharge maintaining ridge lines are the same as the effects described in the first embodiment.

Furthermore, each of the side 56*fe*, the two sides 561*f*, the two sides 562*f* and the two sides 563*f* formed by the cut groove 56*f* also functions as a discharge maintaining ridge line in the present embodiment.

That is, the number of discharge maintaining ridge lines by the cut groove 56*f* being formed is increased more than the case of the first embodiment, and secures a wider degree of freedom regarding positions and shapes of the discharge paths in the present embodiment.

It should be noted that a plurality of cut grooves 56*f* may be formed.

Further, the cut groove 56*f* may be formed on a surface of the center chip 50*f* other than the side surface 53*f*.

An eighth embodiment will be described with reference to FIG. 13.

A spark plug 100 according to the eighth embodiment differs from the first embodiment only in a shape of a center chip 50*g*, and other configurations are the same as those in the first embodiment.

Hereinafter, only points different from the first embodiment will be described, and description common to the first embodiment will be omitted.

A shape of the center chip 50*g* according to the present embodiment is a quadrangular prism (rectangular parallelepiped) similar to that of the first embodiment, and has a shape in which a cut groove 56*g* is formed in a part of the quadrangular prism.

Figure 13:
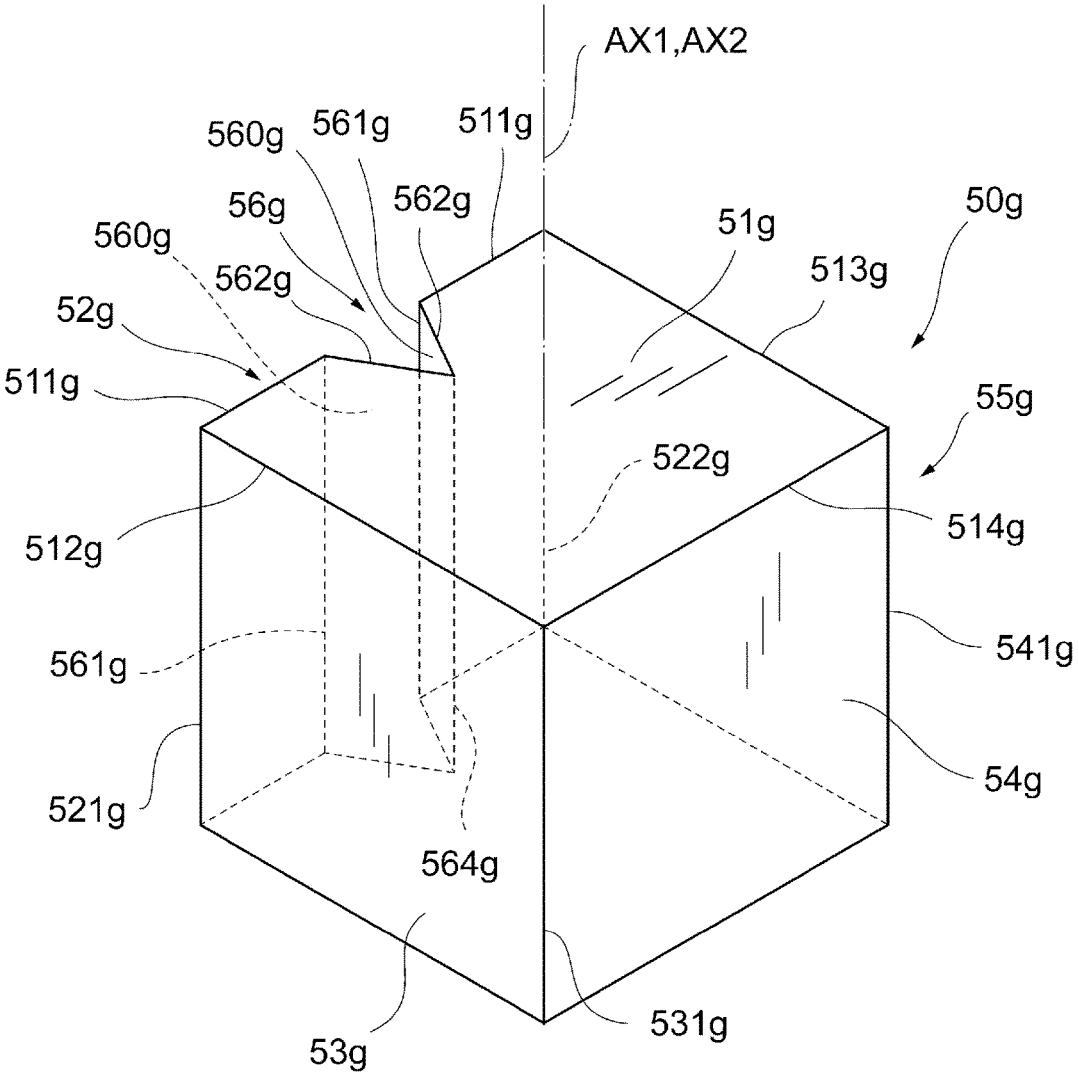
FIG. 13 shows a perspective view of a configuration of a center chip in a spark plug according to an eighth embodiment of the present disclosure.

It should be appreciated that reference numerals are added to elements of the center chip 50*g*, with the suffix g at the end of the reference numerals attached to the corresponding elements in the center chip 50 (refer to FIG. 2) in FIG. 13.

For example, a side corresponding to the side 511 of the center chip 50*g* of the first embodiment is denoted by reference numeral 511*g*. In the following description, the side is referred to as side 511*g*. The same applies to other elements.

The center chip 50*g* is welded and fixed to a distal end surface 31 (not shown in FIG. 13) of a center electrode 30 in a state in which its center axis AX2 is aligned with a center axis AX1 of a metal fitting 10.

The cut groove 56*g* is a concave groove having a V-shaped cross section similar to the cut groove 56*e* in the sixth embodiment, and is formed on a side surface 52*g* of the center chip 50*g*.

The cut groove 56*g* is formed as a linear groove defined by two surfaces 560*g*.

A direction in which the cut groove 56*g* extends is a direction parallel to the center axis AX2.

Since the cut groove 56*e* is formed, a side 511*g* is divided into two.

Two sides 562*g* are formed at the divided position of the side 511*g*.

Each side 562*g* is a side formed between a distal end surface 51*g* and the surface 560*g*.

A ridge line formed along the side 562*g* is a ridge line that forms a boundary between the surface 560*g* which is an inner surface of the cut groove 56*g* and the distal end surface 51*g* which is a surface of the center chip 50*g*.

A linear side 564*g* is formed at a bottom of the cut groove 56*g*, that is, at a portion between the two adjacent surfaces 560*g*.

In addition, a side 561*g* is formed between the surface 560*g* and the side surface 52*g*.

A ridge line formed along the side 561*g* is a ridge line that forms a boundary between the surface 560*g* which is the inner surface of the cut groove 56*g* and the side surface 52*g* which is a surface of the center chip 50*g*.

A portion of the center chip 50*g* having the shortest distance to a ground chip 60 (not shown in FIG. 13) is a side 511*ge* which is a part of edges of the distal end surface 51*g*.

The center chip 50*g* is disposed such that the side 511*g* is parallel to a distal end surface 61 of the ground chip 60.

Therefore, the distance from an arbitrary point on the side 511*ge* to the ground chip 60 is constant regardless of the position of the point.

In other words, the distance from the side 511*g* to the ground chip 60 is equal at all points on the side 511*g*.

As a result, the spark discharge between the center chip 50*ge* and the ground chip 60 is generated starting from any point on the side 511*g*.

A ridge line formed by the side 511*g* is a straight ridge line that forms a boundary between two surfaces (the distal end surface 51*g* and the side surface 52*g*) having different normal line directions, and corresponds to a discharge starting ridge in the present embodiment.

Effects of the discharge starting ridge line are the same as the effects described in the first embodiment.

As in the first embodiment, each of the side 521*g*, the side 522*g*, the side 531*g*, the side 541*g*, the side 512*g*, the side 513*g*, and the side 514*g* corresponds to the discharge maintaining ridge line in the present embodiment.

Effects of these discharge maintaining ridge lines are the same as the effects described in the first embodiment.

Furthermore, each of the side 564*g*, the two sides 561*g*, and the two sides 562*g* formed by the cut groove 56*g* also functions as a discharge maintaining ridge line in the present embodiment.

That is, the number of discharge maintaining ridge lines by the cut groove 56*g* being formed is increased more than the case of the first embodiment, and secures a wider degree of freedom regarding positions and shapes of the discharge paths in the present embodiment.

It should be noted that a plurality of cut grooves 56*g* may be formed.

Further, the cut groove 56*g* may be formed on a surface of the center chip 50*g* other than the side surface 52*g*.

Furthermore, the cut groove 56*e*, the cut groove 56*f*, and the cut groove 56*g* described above may be formed in combination as appropriate.

A ninth embodiment will be described with reference to FIG. 14.

A spark plug 100 according to the ninth embodiment differs from the first embodiment only in a shape of a center chip 50*h*, and other configurations are the same as those in the first embodiment.

Hereinafter, only points different from the first embodiment will be described, and description common to the first embodiment will be omitted.

A shape of the center chip 50*h* according to the present embodiment is a quadrangular prism (rectangular parallelepiped) similar to that of the first embodiment, and has a shape such that a part of a distal end surface 51*h* thereof is obliquely cut.

A surface (cutting surface) formed by such cutting becomes a surface 57*h*.

Figure 14:
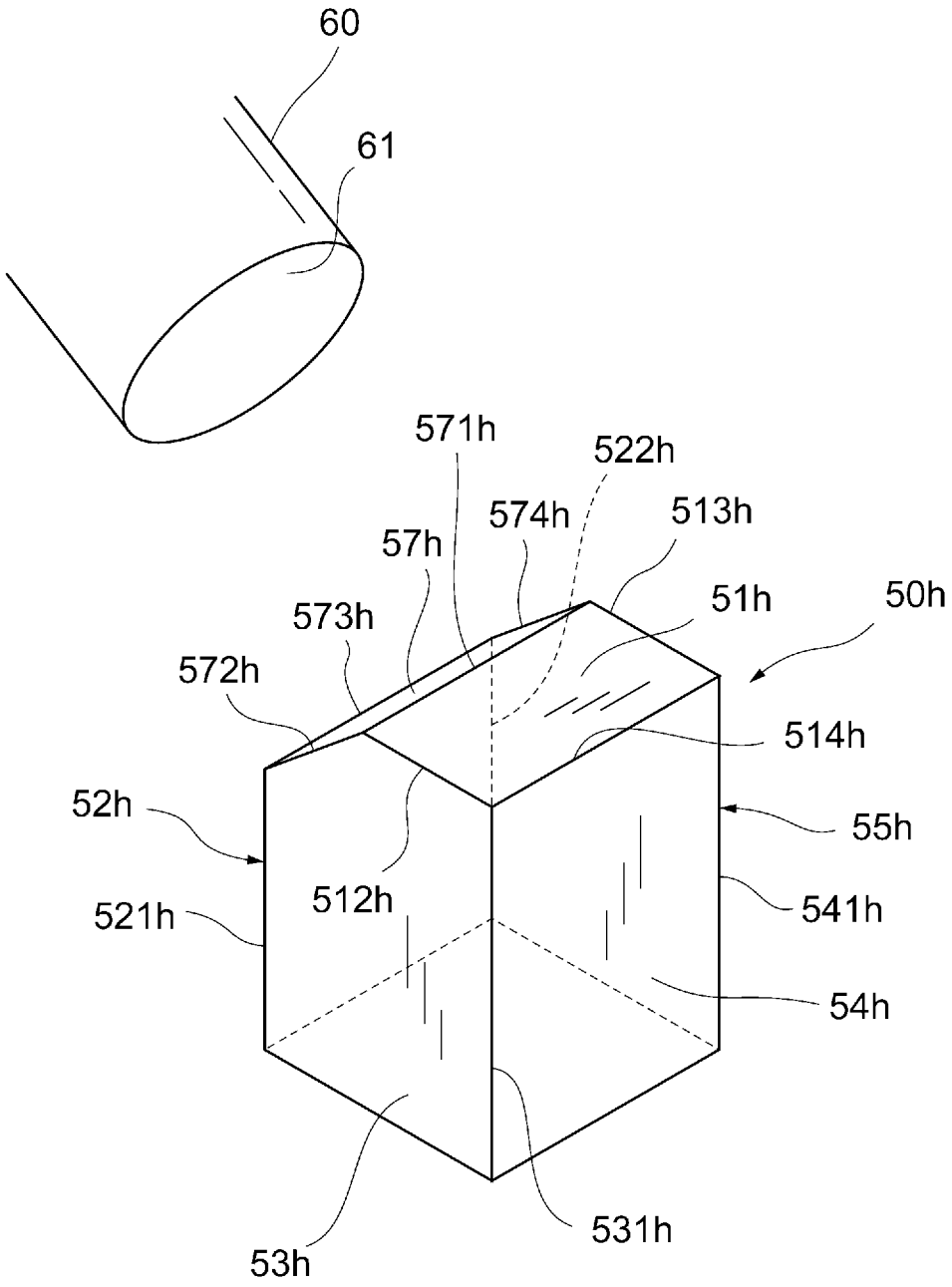
FIG. 14 shows a perspective view of a configuration of a center chip and a ground chip in a spark plug according to a ninth embodiment of the present disclosure.

It should be appreciated that reference numerals are added to elements of the center chip 50*h*, with the suffix h at the end of the reference numerals attached to the corresponding elements in the center chip 50 (refer to FIG. 2) in FIG. 14.

For example, a side corresponding to the side 511 of the center chip 50*h* of the first embodiment is denoted by reference numeral 511*h*. In the following description, the side is referred to as side 511*h*. The same applies to other elements.

The surface 57*h* formed by cutting a part of the center chip 50*h* is a surface parallel to a side 514*h* and is formed as a surface connecting between a distal end surface 51*h* and a side surface 52*h*.

A side 571 is a side between the distal end surface 51*h* and the side surface 52*h*. A side 572*h* is a side between the surface 57*h* and a side surface 53*h*. A side 573*h* is a side between the surface 57*h* and the side surface 52*h*. A side 574*h* is a side between the surface 57*h* and a side surface 55*h*.

The center chip 50*h* is welded and fixed to a distal end surface 31 (not shown in FIG. 14) of a center electrode 30 in a state in which its center axis AX2 is aligned with a center axis AX1 of a metal fitting 10.

A portion of the center chip 50*h* having the shortest distance to a ground chip 60 (not shown in FIG. 14) is a surface 57*h*.

The center chip 50*h* is disposed such that the surface 57*h* is parallel to a distal end surface 61 of the ground chip 60.

Therefore, the distance from an arbitrary point on the surface 57*h* to the ground chip 60 is constant regardless of the position of the point.

In other words, the distance from the surface 57*h* to the ground chip 60 is equal at a portion where the surface 57*h* and the ground chip 60 face each other.

As a result, the spark discharge between the center chip 50*h* and the ground chip 60 is generated starting from any one point on the surface 57*h*.

Each of ridge line formed by edges of the surface 57*h* (the side 571*h*, the side 572*h*, the side 573*h*, the side 574*h*) is a straight ridge line that forms a boundary between two surfaces having different normal line directions, and corresponds to a discharge starting ridge in the present embodiment.

Effects of the discharge starting ridge line are the same as the effects described in the first embodiment.

In this manner, a plurality of discharge starting ridges may be formed in the single center chip 50*h*.

In this case, the distances from the respective discharge starting ridge line to the ground chip 60 is equal to each other.

As in the first embodiment, each of the side 521*h*, the side 522*h*, the side 531*h*, the side 541*h*, the side 512*h*, the side 513*h*, and the side 514*h* corresponds to the discharge maintaining ridge line in the present embodiment.

Effects of these discharge maintaining ridge lines are the same as the effects described in the first embodiment.

A tenth embodiment will be described with reference to FIG. 15.

A spark plug 100 according to the tenth embodiment differs from the first embodiment only in a shape of a center electrode 30*i* and an arrangement of a center chip 50*i*, and other configurations are the same as those in the first embodiment.

Hereinafter, only points different from the first embodiment will be described, and description common to the first embodiment will be omitted.

A normal line of a distal end surface 31*i* of the center electrode 30*i* according to the present embodiment is not disposed along a center axis AX1 but is inclined with respect to the center axis AX1.

Specifically, the normal line of the distal end surface 31*i* is inclined toward a direction in which a ground electrode 40 is disposed.

A shape of the center chip 50*i* welded and fixed to the distal end surface 31*i* is the same as the shape of the center chip 50 according to the first embodiment.

However, since the normal line of the distal end surface 31*i* is inclined as described above, a center axis AX2 of the center chip 50*i* is also inclined.

Figure 15:
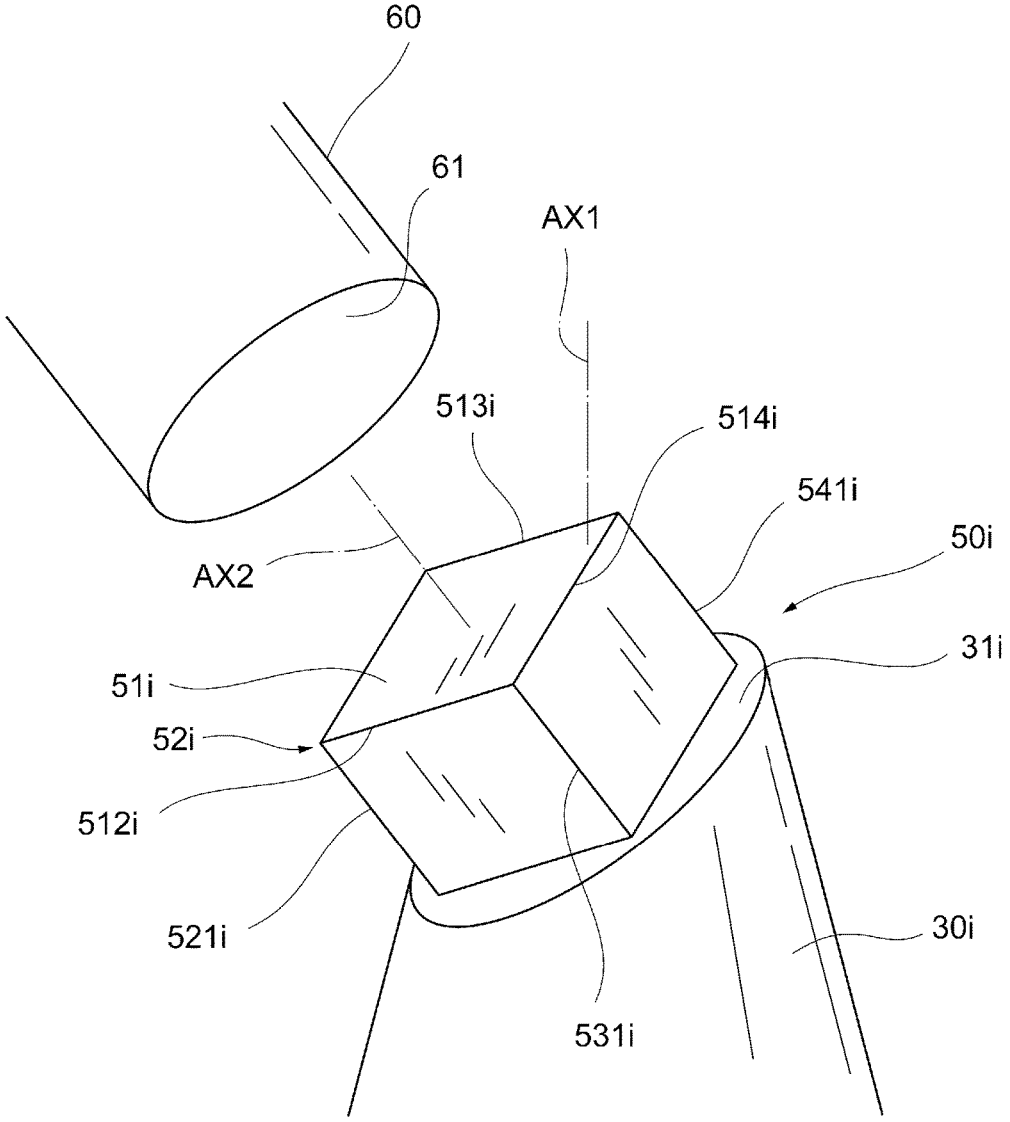
FIG. 15 shows a perspective view of a configuration of a center chip and a ground chip in a spark plug according to a tenth embodiment of the present disclosure.

It should be appreciated that reference numerals are added to elements of the center chip 50*i*, with the suffix i at the end of the reference numerals attached to the corresponding elements in the center chip 50 (refer to FIG. 2) in FIG. 15.

For example, a side corresponding to the side 511 of the center chip 50*i* of the first embodiment is denoted by reference numeral 511*i*. In the following description, the side is referred to as side 511*i*. The same applies to other elements.

A portion of the center chip 50*i* having the shortest distance to a ground chip 60 is a side 511*i* which is a part of edges of the distal end surface 51*i*.

The center chip 50*i* is disposed such that the side 511*i* is parallel to a distal end surface 61 of the ground chip 60.

Therefore, the distance from an arbitrary point on the side 511*i* to the ground chip 60 is constant regardless of the position of the relevant point.

In other words, the distance from the side 511*i* to the ground chip 60 is equal at any point on the side 511*i*.

As a result, the spark discharge between the center chip 50*i* and the ground chip 60 is generated starting from any point on the side 511*i*.

A ridge line formed by the edge 511*i* is a straight ridge line that forms a boundary between two surfaces (the distal end surface 51*i* and the side surface 52*i*) having different normal line directions, and corresponds to a discharge starting ridge line in the present embodiment.

Effects of the discharge starting ridge line are the same as the effects described in the first embodiment.

It should be noted that it is also possible to adjust an inclination angle of the center axis AX2 and dispose the center chip 50*i* such that the distal end surface 51*i* of the center chip 50*i* and the distal end surface 61 of the ground chip 60*i* are parallel to each other.

In this case, edges of the distal end surface 51*i*, that is, each of the sides 511*i*, 512*i*, 513*i*, and 514*i* functions as the discharge starting ridge.

As in the first embodiment, each of the side 521*i*, the side 522*i* (not shown in FIG. 15), the side 531*i*, the side 541*i*, the side 512*i*, the side 513*i*, and the side 514*i* corresponds to the discharge maintaining ridge line in the present embodiment.

Effects of these discharge maintaining ridge lines are the same as the effects described in the first embodiment.

Although a case where a part of the ground electrode 40 is inclined with respect to the center axis AX1 has been described as an example in the above description, the ground electrode 40 may be formed so that the entire ground electrode 40 is parallel to the center axis AX1.

Even in such a case, in a configuration in which the center axis of the ground chip 60 is inclined with respect to the center axis AX1, for example, the shape of the center chip 50 is similar to the shape described above, and by doing so, it is possible to achieve the same effects as the effects described in the first embodiment.

The embodiments of the present disclosure have been described with reference to specific examples.

However, the present disclosure is not limited to these specific examples.

That is, those in which design modifications are appropriately made by those skilled in the art to these specific examples are also included in the scope of the present disclosure as long as they have the features of the present disclosure.

For example, elements, and arrangement, material, condition, shape, size, and the like of the elements equipped with the respective specific examples described above are not limited to those exemplified and can be appropriately modified.

In addition, the elements included in each of the above-described embodiments can be combined as far as technically possible, and combinations thereof are also included within the scope of the present disclosure as long as the features of the present disclosure are included.

What is claimed is:

1. A spark plug for an internal combustion engine comprising:

a columnar metal fitting;

a center electrode disposed along a center axis of the metal fitting and supported in a state of being electrically insulated from the metal fitting;

a center chip disposed so as to protrude from a part of the center electrode;

a ground electrode of which one end is fixed to the metal fitting and at least a part of the ground electrode is inclined with respect to the center axis so as to approach the center axis of the metal fitting toward another end of the ground electrode; and a ground chip disposed so as to protrude from a part of the ground electrode toward the center chip; wherein, a center axis of the ground chip is inclined with respect to the center axis of the metal fitting;

when the center chip is defined as a first chip and the ground chip is defined as a second chip, a discharge starting ridge line, which is a straight ridge line that forms a boundary between two surfaces having different normal line directions, is formed in a portion closest to the second chip in the first chip, and a distance from the discharge starting ridge line to the second chip is configured to be equal at a portion where the first chip and the second chip are opposed to each other.

2. The spark plug according to claim 1, wherein, the first chip is formed such that a distal end surface thereof is a polygon, and the discharge starting ridge line is one of sides of the polygon.

3. The spark plug according to claim 2, wherein, the discharge starting ridge line is the longest side among the plurality of sides of the polygon.

4. The spark plug according to claim 1, wherein, a plurality of the discharge starting ridge lines are formed on the first chip, and distances from the discharge starting ridge lines to the second chip are equal to each other.

5. The spark plug according to claim 1, wherein, discharge maintaining ridge lines, which are ridge lines that form boundaries between two surfaces having different normal line directions, are further formed at different positions on the first chip, and the discharge maintaining ridge lines are connected to the discharge starting ridge line.

6. The spark plug according to claim 5, wherein, at least a part of the discharge maintaining ridge line is formed on a side surface of the first chip.

7. The spark plug according to claim 5, wherein,

A concave groove is formed in the first chip, and at least a part of the discharge maintaining ridge line is a ridge line that forms a boundary between a surface of the first chip and an inner surface of the groove.

8. A spark plug for an internal combustion engine comprising:

a columnar metal fitting:

a center electrode disposed along a center axis of the metal fitting and supported in a state of being electrically insulated from the metal fitting;

a center chip disposed so as to protrude from a part of the center electrode;

a ground electrode fixed to the metal fitting; and a ground chip disposed so as to protrude from a part of the ground electrode toward the center chip; wherein, a center axis of the ground chip is inclined with respect to the center axis of the metal fitting;

when the center chip is defined as a first chip and the ground chip is defined as a second chip, a discharge starting ridge line, which is a straight ridge line that forms a boundary between two surfaces having different normal line directions and opposes to a distal end surface of the second chip, is formed at a portion in of the first chip that is closest to the second chip, and the shortest distance from the discharge starting ridge line to the second chip is configured to be equal at a portion where the first chip and the second chip are opposed to each other.

9. The spark plug according to claim 1, wherein the shape of the center chip is a rectangular parallelepiped.

10. The spark plug according to claim 8, wherein the shape of the center chip is a rectangular parallelepiped.

11. The spark plug according to claim 1, wherein:

the first chip includes a distal end surface having the shape of a triangle, and the discharge starting ridge line is one of sides of the triangle.

12. The spark plug according to claim 8, wherein:

the first chip includes a distal end surface having the shape of a triangle, and the discharge starting ridge line is one of sides of the triangle.

13. The spark plug according to claim 1, wherein the shape of the center chip is a hexagonal prism.

14. The spark plug according to claim 8, wherein the shape of the center chip is a hexagonal prism.

15. The spark plug according to claim 1, wherein:

the first chip includes a distal end surface including a linear portion and an arcuate portion, and the discharge starting ridge line is the linear portion of the distal end surface.

16. The spark plug according to claim 8, wherein:

the first chip includes a distal end surface including a linear portion and an arcuate portion, and the discharge starting ridge line is the linear portion of the distal end surface.

17. The spark plug according to claim 1, wherein the shape of the center chip is a quadrangular prism having a cut groove.

18. The spark plug according to claim 8, wherein the shape of the center chip is a quadrangular prism having a cut groove.

19. The spark plug according to claim 1, wherein the shape of the center chip is a circular columnar shape having a distal end surface that is obliquely cut.

20. The spark plug according to claim 8, wherein the shape of the center chip is a circular columnar shape having a distal end surface that is obliquely cut.

* * * * *